US008734587B2

(12) United States Patent
Pruyn et al.

(10) Patent No.: US 8,734,587 B2
(45) Date of Patent: May 27, 2014

(54) CONCRETE MIXING TRUCK CHUTE WASHING APPARATUS AND METHOD OF USING SAME

(76) Inventors: Greg Pruyn, Edina, MN (US); Bradley T. Burke, Apple Valley, MN (US)

( * ) Notice: Subject to any disclaimer, the term of this patent is extended or adjusted under 35 U.S.C. 154(b) by 363 days.

(21) Appl. No.: 13/191,015

(22) Filed: Jul. 26, 2011

(65) Prior Publication Data

US 2012/0111364 A1 May 10, 2012

Related U.S. Application Data

(60) Provisional application No. 61/412,092, filed on Nov. 10, 2010.

(51) Int. Cl.
*B08B 7/04* (2006.01)

(52) U.S. Cl.
USPC ..... 134/10

(58) Field of Classification Search
None
See application file for complete search history.

(56) References Cited

U.S. PATENT DOCUMENTS

| | | | | |
|---|---|---|---|---|
| 6,039,468 | A | 3/2000 | Kowalcyzk | |
| 6,155,277 | A | 12/2000 | Barry | |
| 7,117,995 | B2 | 10/2006 | Connard, III | |
| 7,506,672 | B2 * | 3/2009 | Manno | 141/86 |
| 7,594,524 | B2 | 9/2009 | DeCollibus et al. | |
| 2004/0159595 | A1 | 8/2004 | Connard, III | |
| 2006/0000490 | A1 | 1/2006 | Barragan et al. | |
| 2010/0232253 | A1 | 9/2010 | Lundberg et al. | |

FOREIGN PATENT DOCUMENTS

WO WO 2010/027560 3/2010

OTHER PUBLICATIONS

International Search Report and Written Opinion dated Jan. 5, 2012 for PCT/US11/45344.
International Preliminary Report on Patentability dated May 23, 2013 for PCT/US11/45344, pp. 1-9.

* cited by examiner

*Primary Examiner* — Jason Ko
(74) *Attorney, Agent, or Firm* — Robert E. Richards

(57) ABSTRACT

The invention comprises an apparatus for washing, storing and transporting concrete wastewater washed from concrete conveying chutes associated with a concrete mixing truck. The apparatus comprises a fluid container having a first opening and a pair of arms extending upwardly above the container. Each end of the arms distal from the container is adapted to mate with a first end of a first concrete chute member and to removably retain the first concrete chute member such that a second end of the first concrete chute member is higher than the first end and the first end is disposed above the first opening in the fluid container. The container is attachable to a concrete mixing truck such that a second concrete chute member attached to the concrete mixing truck can be positioned above the first concrete chute member while the first concrete chute member is mated with the arms. A method of using the apparatus is also disclosed.

7 Claims, 18 Drawing Sheets

CONCRETE MIXING TRUCK CHUTE WASHING APPARATUS AND METHOD OF USING SAME

CROSS-REFERENCE TO RELATED APPLICATIONS

The present application claims the benefit of provisional patent application Ser. No. 61/412,092 filed Nov. 10, 2010, the entire contents of which are incorporated herein by reference.

FIELD OF THE INVENTION

The present invention relates generally to concrete delivery chutes on concrete mixing trucks. More particularly, the present invention relates to apparatus for cleaning waste concrete from delivery chutes contaminated therewith and for storing and disposing of contaminated water used to wash concrete delivery chutes. The present invention also relates to a method for cleaning waste concrete from delivery chutes contaminated therewith and for storing and disposing of contaminated water used to wash concrete delivery chutes.

BACKGROUND OF THE INVENTION

Concrete is a widely used building material. In fact, concrete is used more than any other man-made material in the world. Generally speaking, concrete is a composite construction material, composed of cement (commonly Portland cement) or other cementitious materials, and aggregate. Concrete can also include various additives, such as accelerators, retarders, plasticizers, pigments and the like. Concrete solidifies and hardens after mixing with water and placement due to a chemical process known as hydration.

Concrete is typically used in two forms, pre-cast or poured-in-place. For poured-in-place applications, concrete is usually delivered to a construction site by a concrete mixing truck. Concrete mixing trucks usually have a rotatable mixing drum mounted on a truck bed. At a concrete plant, the mixing drum on the truck is charged with a desired amount of the concrete mixture and water. The rotating mixing drum thoroughly combines the concrete constituents and the water and prevents segregation of the aggregate during transportation to a job site so that a relatively homogeneous mixture can be provided.

At a job site, a concrete mixing truck dispenses the concrete mixture from the drum. The concrete mixture is typically conveyed from the mixing drum to the location where the concrete is to be placed through the use of a concrete chute. The concrete chute is usually a U-shaped trough that is pivotally attached to the truck and can be raised and lowered using a hydraulic system. The concrete chute system on a concrete mixing truck usually includes two chute sections pivotally attached to each other so that they can be folded together when the truck is moving and unfolded when needed at a job site. Additional concrete chute sections can be temporarily attached to the chute sections attached to the truck in order to extend the chute a desired distance to reach to location where the concrete is to be placed. Concrete then flows from the drum down the chute due to gravitational forces to a location for placement, such as a concrete form for a basement wall, footing, foundation, floor or other concrete structure.

After the concrete has been dispensed from the mixing drum, the chute is contaminated with the concrete mixture that sticks to the surface of the chute. In the past, a truck operator would clean the concrete from the chute by merely spraying water onto the chute and allowing the water and concrete mixture to fall onto the ground. Recently, however, concerns have grown regarding the potential from contamination of ground water with the concrete contaminated water used to wash the concrete chute. In fact, the Environmental Protection Agency ("EPA") has established guidelines that waste concrete mix water can no longer be disposed of by washing onto the ground at a job site. The EPA now has guideline, and many state regulations prescribe, that the concrete washed from a concrete chute and the contaminated water used to wash the chute must be stored and transported away from the job site for disposal in an environmentally appropriate manner such that contaminated water will not pose a threat to local ground water.

As a result of these regulations, many different concrete chute washing systems have been developed. U.S. Pat. Nos. 6,155,277; 7,117,995; and 7,594,524 and U.S. patent application Publication Nos. 2006/0000490 and 2010/0232253 and PCT patent application Publication No. WO 2010/027560 illustrate several such concrete chute washing systems (all of which are incorporated herein by reference in their entirety). These systems are undesirable because, inter alia, they are complicated, difficult to assemble and/or operate, inefficient to operate, employ parts that can easily be lost or broken, involve pumps and hoses that can become clogged or break down and/or buckets that may create lifting hazards.

It would therefore be desirable to provide a concrete chute washing system that overcomes the problems associated with the prior art. Specifically, it would be desirable to provide a concrete chute washing system that is relatively easy to assemble and use, is efficient, involves few parts, requires no moving parts or pumps and is durable under the conditions experienced by concrete mixing trucks.

SUMMARY OF THE INVENTION

The present invention satisfies the foregoing needs by providing an improved concrete chute washing system. In one disclosed embodiment, the present invention comprises a fluid container having a first opening and a pair of arms extending upwardly above the container, each end of the arms distal from the container being adapted to mate with a first end of a first concrete chute member and to removably retain the first concrete chute member such that a second end of the first concrete chute member is higher than the first end and the first end is disposed above the first opening in the fluid container. The container is attachable to a concrete mixing truck such that a second concrete chute member attached to the truck can be positioned above the first concrete chute member while the first concrete chute member is mated with the arms. In another disclosed embodiment, a longitudinal axis of the first concrete chute member is substantially parallel to a longitudinal axis of the concrete mixing truck when the first concrete chute member is mated with the arms.

In another disclosed embodiment, the present invention comprises a method for washing concrete chutes on a concrete mixing truck. The method comprises positioning a first concrete chute member such that a first end of the first concrete chute member is disposed above an opening in a container attached to a concrete mixing truck and the first concrete chute member is maintained at an angle such that a second end of the first concrete chute member is higher than the first end thereof. The method also includes positioning a second concrete chute member above the first concrete chute member, such that a first end of the second concrete chute member is higher than a second end of the second concrete chute member and such that water applied to the second concrete chute member washes contaminants therefrom onto the first concrete chute member which then flows from the first concrete chute member into the container and applying water to the second concrete chute member such that the water washes contaminants therefrom onto the first concrete chute member which then flows from the first concrete chute member into the container. In another disclosed embodiment, a longitudinal axis of the first concrete chute is substantially parallel to a longitudinal axis of the concrete mixing truck.

Accordingly, it is an object of the present invention to provide an improved concrete chute washing system.

Another object of the present invention is to provide a concrete chute washing system that is relatively easy to manufacture and/or to assemble.

A further object of the present invention is to provide a concrete chute washing system that is more efficient to use.

Yet another object of the present invention is to provide a concrete chute washing system that involves relatively few parts.

Another object of the present invention is to provide a concrete chute washing system that requires no moving parts.

Another object of the present invention is to provide a concrete chute washing system that does not require fluid pumps, hoses or buckets.

Still another object of the present invention is to provide a concrete chute washing system that is durable under the conditions experienced by concrete mixing trucks.

Another object of the present invention is to provide a concrete chute washing system that prevents contaminated concrete chute wash water from contaminating the environment.

These and other objects, features and advantages of the present invention will become apparent after a review of the following detailed description of the disclosed embodiments and the appended drawing and claims.

DETAILED DESCRIPTION OF THE DISCLOSED EMBODIMENTS

Figure 1:
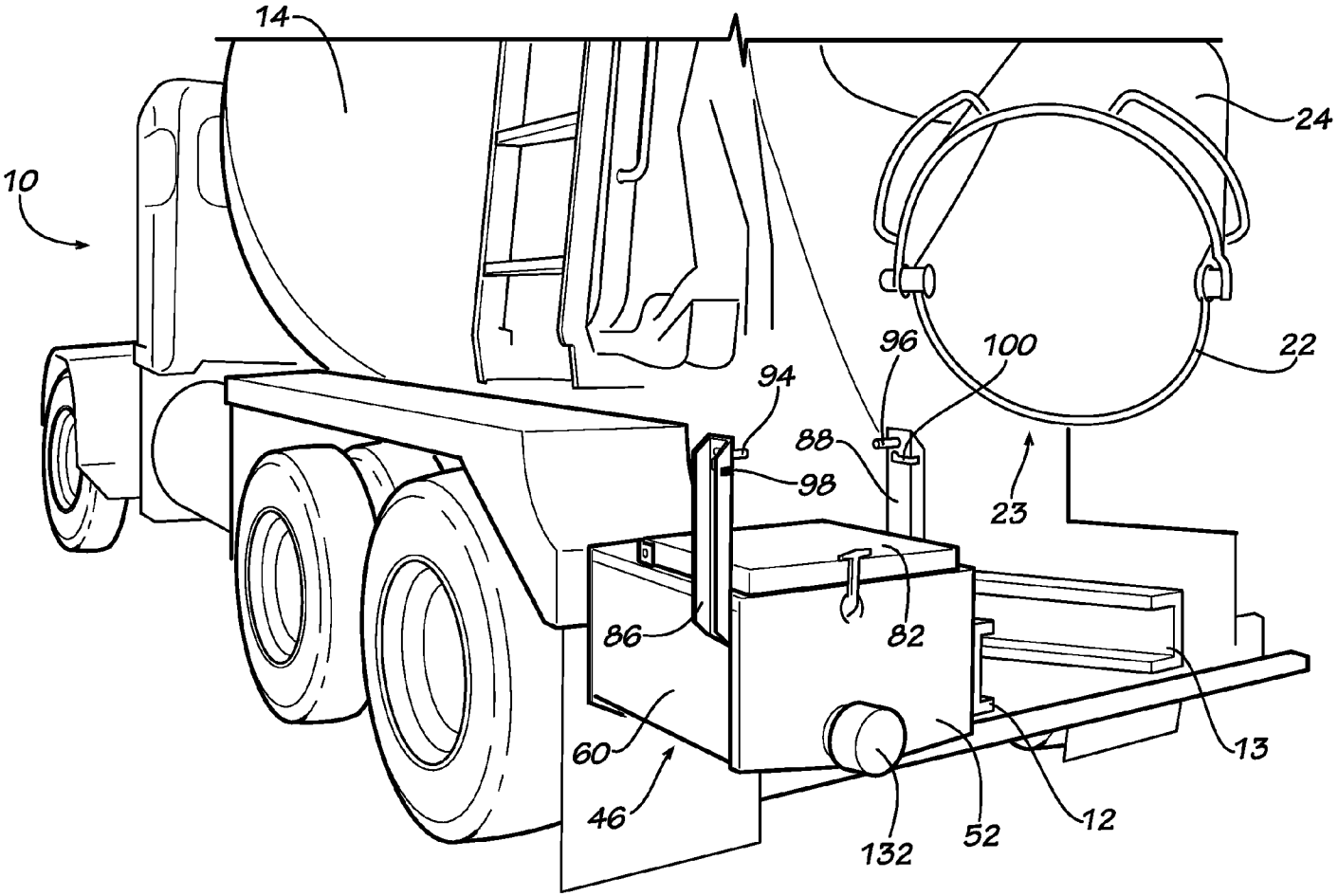
FIG. 1 is a partial rear perspective view of a typical concrete mixing truck having attached to a rear portion of the truck a disclosed embodiment of the wash fluid container of the present invention.
Figure 2:
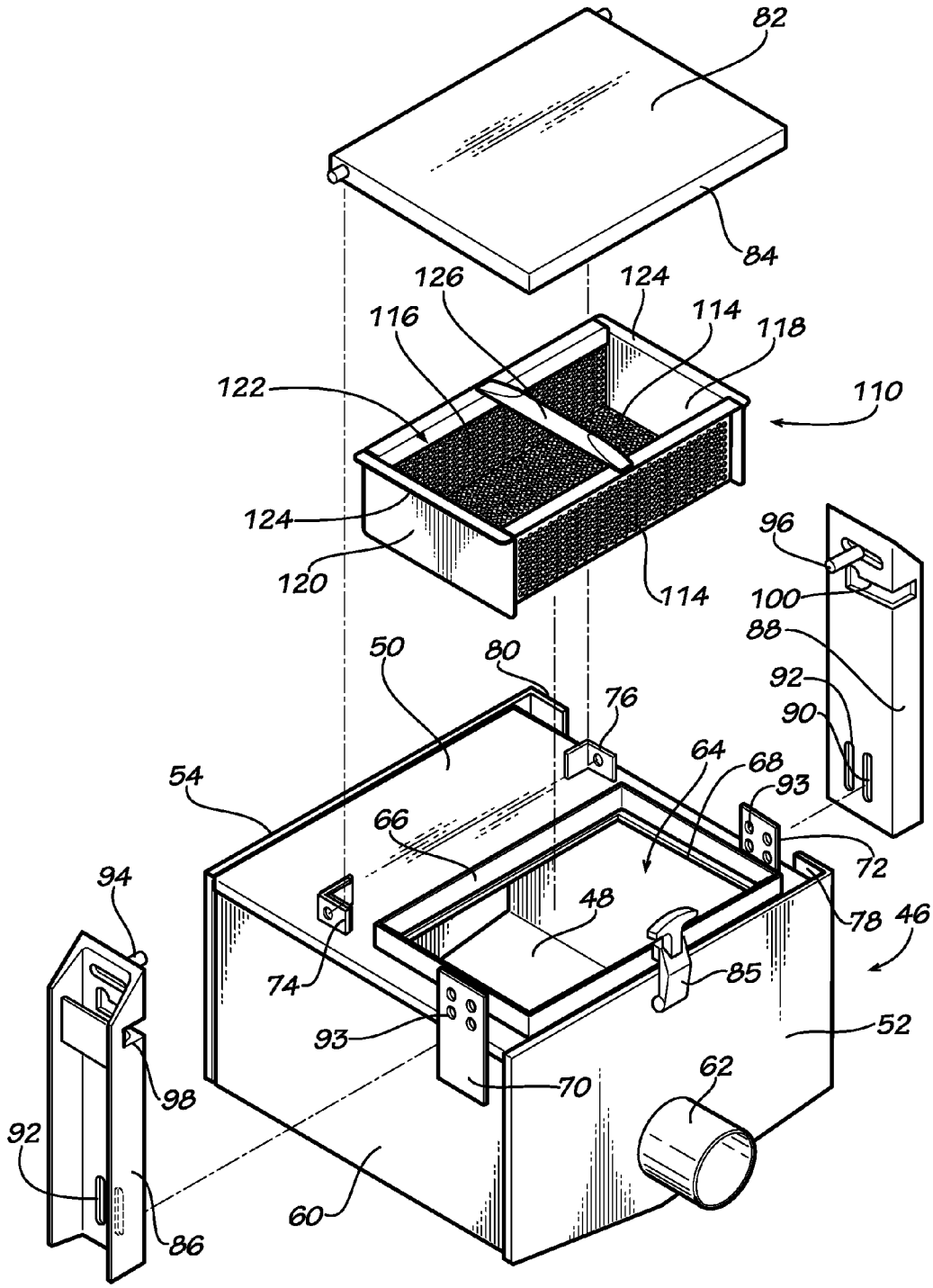
FIG. 2 is an exploded perspective view of the wash fluid container shown in FIG. 1.
Figure 3:
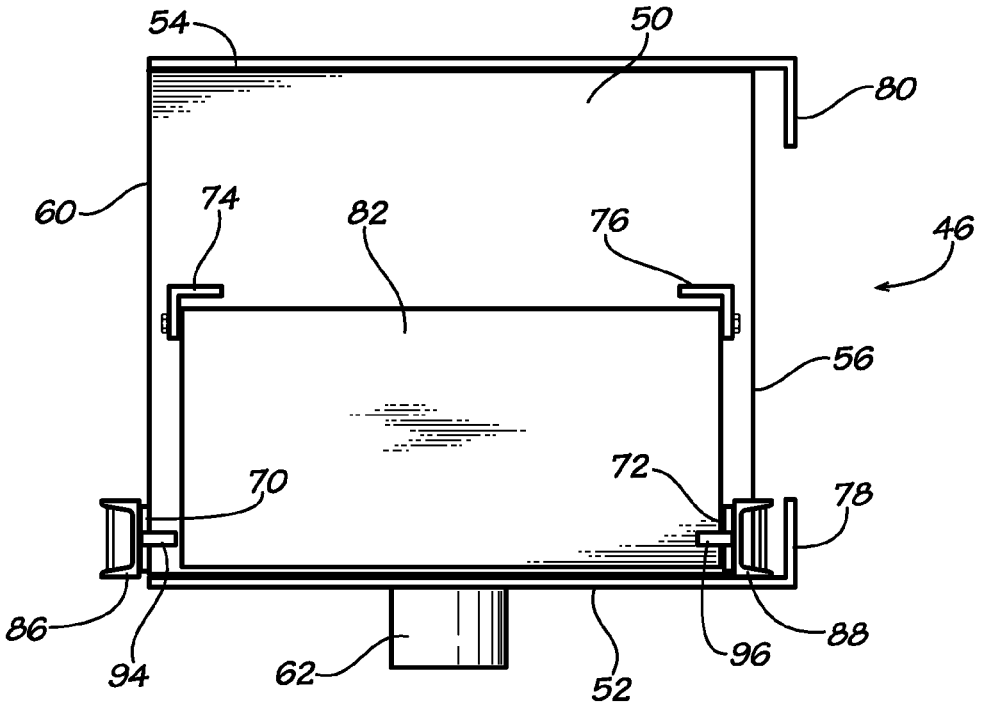
FIG. 3 is a top plan view of the wash fluid container shown in FIG. 1.
Figure 4:
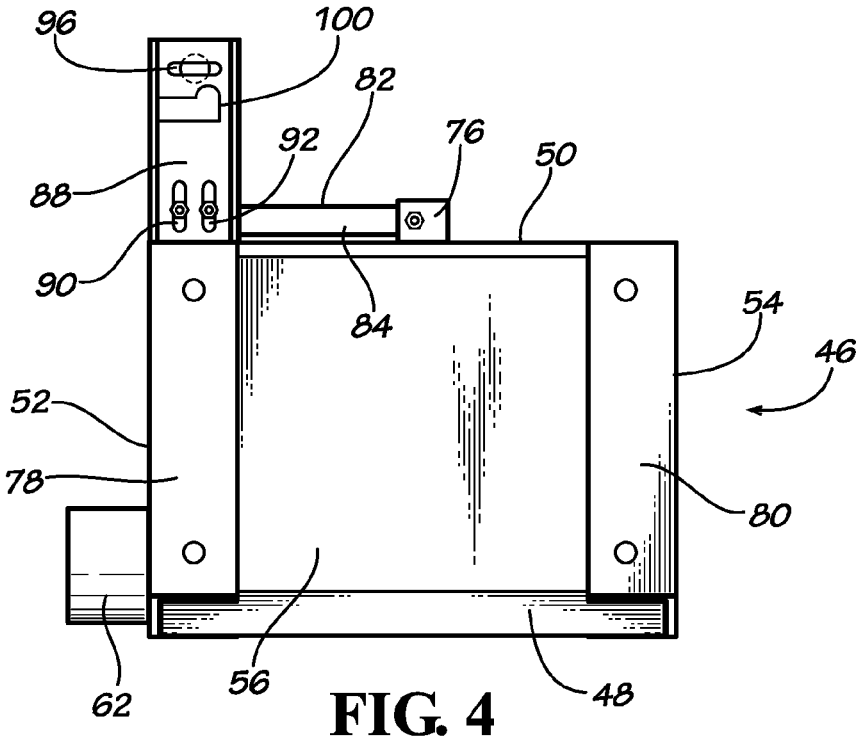
FIG. 4 is a right side view of the wash fluid container shown in FIG. 1.
Figure 5:
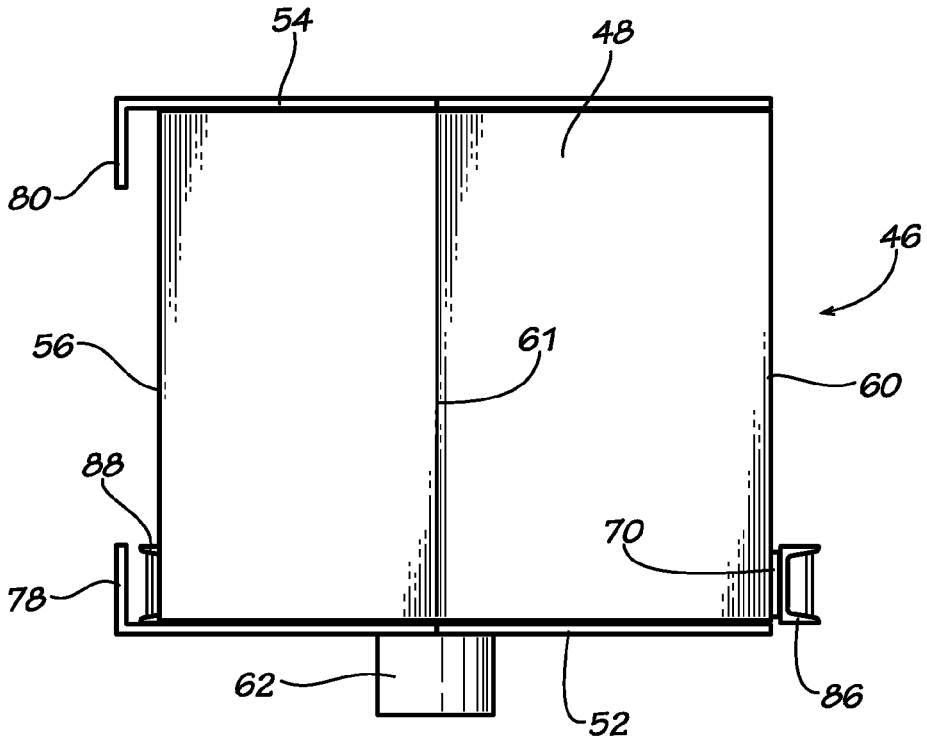
FIG. 5 is a bottom view of the wash fluid container shown in FIG. 1.
Figure 7:
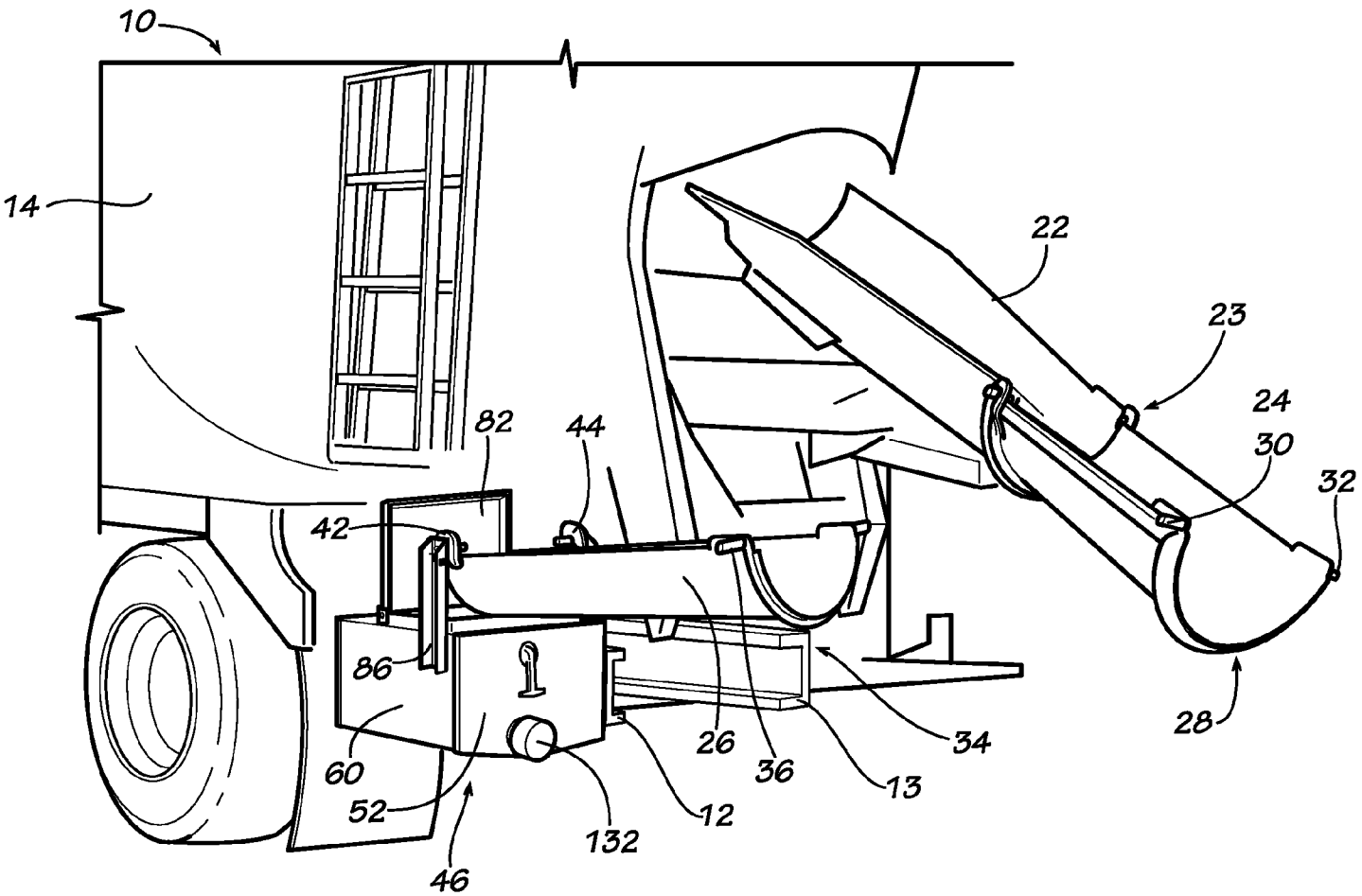
FIG. 7 is a partial rear perspective view of the concrete mixing truck and wash fluid container shown in FIG. 6 showing the main chute and the flop-down chute still in the extended position, but showing a concrete chute extension mounted on the wash fluid container in accordance with the present invention.

Referring now to the drawing in which like numbers indicate like elements throughout the several views, there is shown in FIG. 1 a convention concrete mixing truck 10. The mixing truck 10 includes a truck bed frame rails 12, 13 upon which is rotatably mounted a concrete mixing tank 14. The concrete mixing tank 14 is connected to an electric motor (not shown) that rotates the mixing tank at a desired speed and in a desired direction. Concrete ingredients, such as Portland cement, sand, aggregate, water and concrete additives, are charged into the concrete mixing tank 14 through the load charging hopper 16 (which is also known in the art as a fill hopper or loading hopper). The concrete mixing tank 14 includes helical flights (not shown) inside the mixing tank that mix the concrete mixture to assure a homogeneous mixture and to prevent segregation of the particulate material during transport. Thus, when the concrete mixing tank 14 is rotated in one direction, the flights mix the concrete. When the concrete mixing tank 14 is rotated in the opposite direction, the flights convey the concrete mix from inside the mixing tank to the opening 18 of the mixing tank where the concrete mix spill out of the tank under the influence of gravity and fall onto or through a discharge hopper 20 that funnels or directs the concrete mix onto a main concrete chute 22. The main concrete chute 22 is pivotably attached to the discharge hopper 20 in a manner well known in the art so that the main chute can move side-to-side and up and down in order to facilitate placement of the concrete mix in a desired location. The main chute 22 may be attached to a hydraulically operated arm (not shown) that facilitates raising or lowering the main chute. Typically, the discharge end 23 of the main chute 22 is pivotably attached to a flop-down chute 24 (which is also known in the art as a fold-back chute). The flop-down chute 24 is typically lowered from its stored position, as shown in FIG. 1, to its lowered position, as shown in FIG. 7, to extend the reach of the main chute 22.

Figure 6:
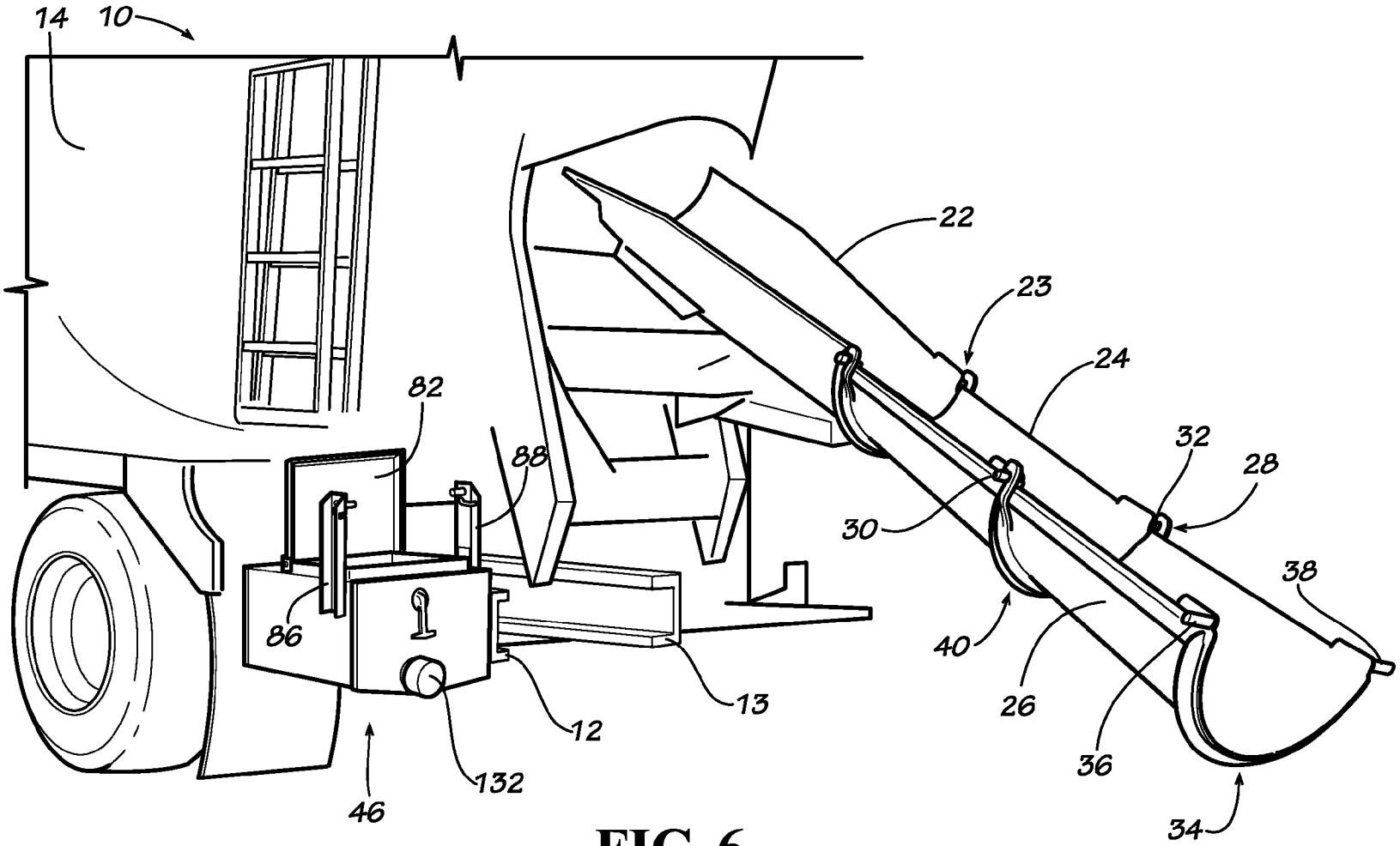
FIG. 6 is a partial rear perspective view of the concrete mixing truck and wash fluid container shown in FIG. 1 showing the main chute, flop-down chute and one concrete chute extension in their extended configuration for placing concrete from the concrete mixing tank on the truck.
Figure 13:
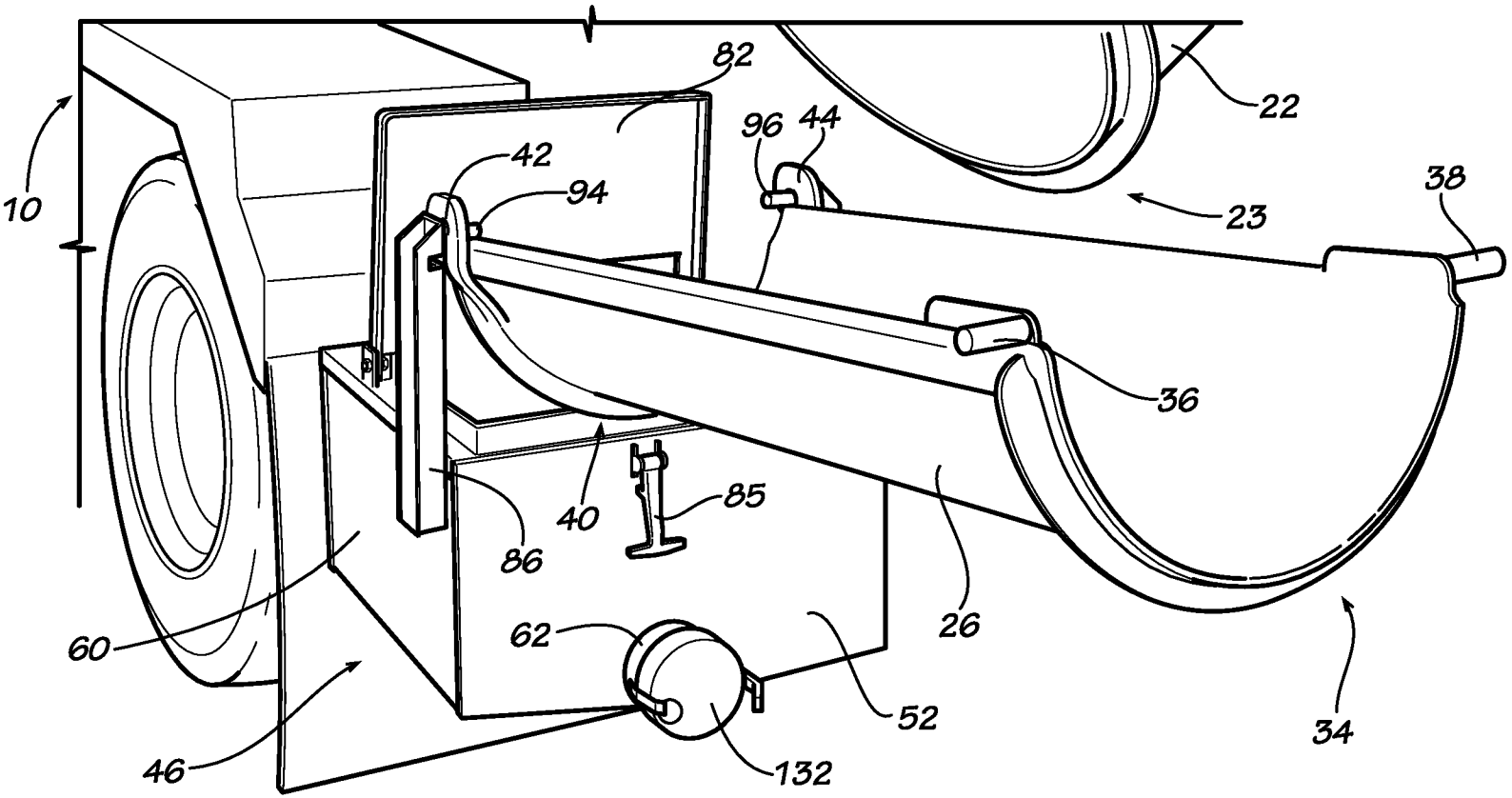
FIG. 13 is a partial rear detail perspective view of the concrete mixing truck and wash fluid container shown in FIG. 9 showing the concrete chute extension attached to the wash fluid container and the discharge end of the main chute position over the concrete chute extension.
Figure 17:
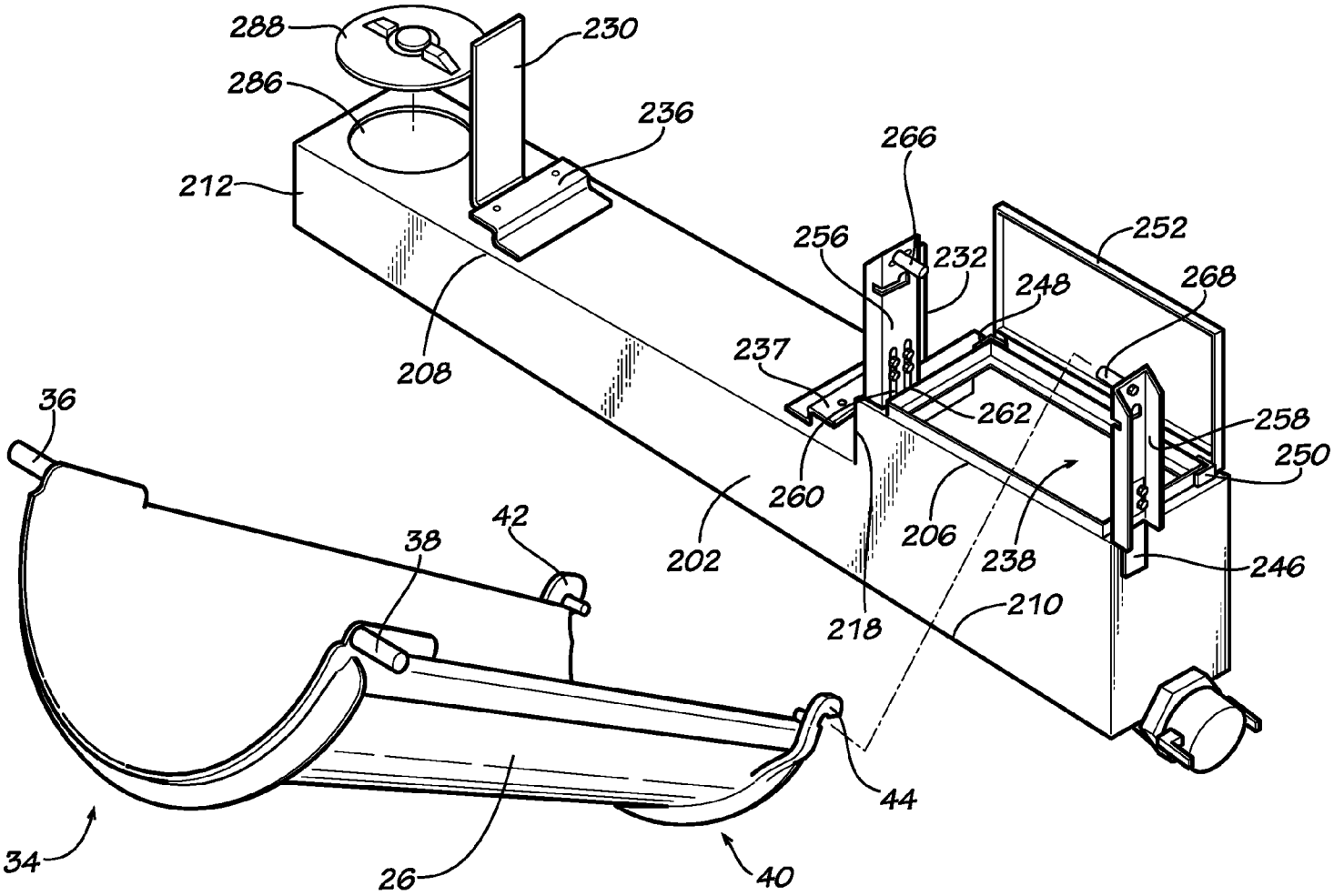
FIG. 17 is an exploded partial rear perspective view of a concrete mixing truck and an alternate disclosed embodiment of a wash fluid container in accordance with the present invention showing a concrete chute extension exploded away from the wash fluid container.

If the main chute 22 needs to be extended further than the flop-down chute 24, additional chute extensions, such as the extension chute 26, can be attached to the discharge end 28 of the flop-down chute. If an ever further extension is needed, additional chute extensions (not shown) can be attached in series to the previous chute or chute extension. Chute extensions may be of different configurations, designs and sizes depending on the manufacturer thereof. Typically, a chute extension will have connectors at the opposite ends thereof. For example one end of a chute extension may have a male connector and the opposite end may have a female receptacle. This allows multiple chute extensions to be chained together. Again, depending on the manufacturer, the discharge end 28 of the flop-down chute 24 may include either a male connector or a female receptacle. In the embodiment illustrated herein, the discharge end 28 of the flop-down chute 24 includes a male connectors in the form of posts 30, 32 extending outwardly from the discharge end of the flop-down chute. One end 34 of the extension chute 26 includes posts 36, 38 extending outwardly from the chute; the opposite end 40 of the extension chute includes hooks 42, 44 extending outwardly and upwardly from the end 40 of the chute 26 (FIGS. 13 and 17). The hooks 42, 44 on the end 40 of the extension chute 26 mate with the posts 30, 32 on the discharge end 28 of the flop-down chute 24 to form a temporary connection between the extension chute and the flop-down chute (FIG. 6). The extension chute 26 can be removed easily from the flop-down chute 24 by raising the end 34 of the extension chute and disengaging the posts 30, 32 on the flop-down chute 24 from the hooks 42, 44 on the extension chute.

The design, construction and operation of the concrete mixing truck 10 and the chute system, as described above, is completely conventional and well known in the art. The novel and unobvious features and methods of operation of the present invention will now be described below.

Attached to the truck bed frame 12 at the rear of the truck 10 is a fluid container 46. The fluid container 46 should be of sufficient capacity to contain all the water used to wash the load charging hopper 16, the discharge hopper 20, the main concrete chute 22, the flop-down chute 24 and any chute extensions, such as the extension chute 26. For example, in the presently disclosed embodiment, the fluid container 46 has a capacity of 25 gallons. However, fluid containers 46 having larger or smaller capacities can be used depending on the size of the concrete mixing tank 14, truck configuration and associated hopper and chute equipment. The fluid container 46 is shown as generally rectangular, however, any other suitable shape can be used, such as square, round or the like. The fluid container 46 can also be made out of any suitable material that is relatively durable and is watertight. In the disclosed embodiment, the fluid container 46 is made from ¼ inch plate steel that is welded together at the joints. By making the fluid container 46 out of welded plate steel, it is very durable and able to withstand the harsh working conditions associated with a concrete mixing truck.

The fluid container 46 comprises a bottom panel 48, a top panel 50, a front panel 52, a rear panel 54, a right side panel 56 and a left side panel 60. In the disclosed embodiment, the bottom panel 50, the right side panel 56 and the left side panel 60 are fabricated from a single sheet of plate steel that has been bent into the illustrated U-shape. By using this construction, the front panel 52 and rear panel 54 can be welded to the single piece of steel forming the bottom panel 50, the right side panel 56 and the left side panel 60. Then, the top panel 50 is welded to the front panel 52, the rear panel 54, the right side panel 56 and the left side panel 60. While the top panel 50, the front panel 52, the rear panel 54, the right side panel 56 and the left side panel 60 are all flat, the bottom panel 48 include a central bend 61, which gives the bottom panel a V-shape. A through hole is formed in the front panel 52 and a drainpipe 62 extending outwardly from the front panel is welded in the hole. The drainpipe 62 is aligned with the V-shape bend 61 in the bottom panel 48 so that fluid in the fluid container 46 will flow out of the drainpipe under the influence of gravity.

A rectangular opening 64 is formed in the top panel 50. An upstanding rectangular frame 66 is formed around the opening 64 and is welded to the top panel 50. The frame 66 is slightly larger than the opening 64 so that the portion of the top panel 50 that extends inwardly from the frame forms a ledge 68 surrounding the opening. Two mounting brackets 70, 72 extend upwardly from the surface of the top panel 50. The mounting bracket 70 is welded to the left side panel 60 and the other mounting bracket 72 is welded to the top panel 50. Two hinge brackets 74, 76 extend outwardly from the top panel 50 and are welded thereto.

The front panel 52 and the rear panel 54 extend outwardly from the right side panel 56 and a bend in the front panel and rear panel forms two L-shaped fluid container mounting brackets 78, 80. The mounting brackets 78, 80 are provided for mounting the fluid container 46 to the truck bed frame rail 12, such as by bolting.

A rectangular lid 82 is pivotably attached to the hinge brackets 74, 76 so that the lid can be raised and lowered to uncover and cover, respectively, the opening 64 in the top plate 50. The rectangular lid 82 has downturned edges 84 which are slightly larger than the frame 66 so that the rectangular lid fits over the frame. A sealing gasket (not shown) is provided on the underside of the rectangular lid 82 so that the gasket seals against the frame 66 when the lid is closed, thereby providing a watertight seal. A latch 85 is provided for selectively fastening or releasing the rectangular lid from the closed position.

A pair of elongate, adjustable arms 86, 88 is mounted on the mounting brackets 70, 72. Each of the arms 86, 88 includes a pair of slots 90, 92 formed therein. The arms 86, 88 are mounted to the mounting brackets 70, 72 by inserting bolts (not shown) through the slots 90, 92 and through corresponding holes 93 in the corresponding mounting bracket. A nut (not shown) fits on the bolt thereby securing the arms 86, 88 to the mounting brackets 70, 72, respectively. The slots 90, 92 in the arms 86, 88 allow the arms to be raised or lowered to thereby accommodate concrete chute extensions of different dimensions.

On each of the arms 86, 88 adjacent the ends distal from the mounting brackets 70, 72 are a pair of pins 94, 96, respectively, that extend inwardly toward each other. The pins 94, 96 are sized and shaped to mate with hooks that are typically found on one end of a concrete chute extension, such as the hooks 42, 44 on the concrete chute extension 26 (FIG. 13). On each of the arms 86, 88 adjacent the ends distal from the mounting brackets 70, 72 are a pair of slots 98, 100, respectively, that are sized and shaped to mate with the pins that are typically found on one end of a concrete chute extension, such as the pins 36, 38 on the concrete chute extension 26. The arms 86, 88 are adjusted to a height so that when a concrete chute extension is attached to the arms one end of a concrete chute extension is positioned over the opening 64 in the top panel 50 of the fluid container 46 and the other end of the chute is at a higher elevation than the end over the opening, such as shown in FIG. 13 where the end 34 of the concrete chute extension 26 is higher than the end 40. Therefore, when a concrete chute extension is mounted on the arms 86, 88, as described above, any fluid, such as water, on the concrete chute extension will drain into the fluid container 46 under the influence of gravity. Furthermore, when a concrete chute extension is mounted on the arms 86, 88, as described above and the fluid container 46 is mounted on the concrete mixing truck 10 as described below, the longitudinal axis of the concrete chute extension will be parallel to the longitudinal axis of the concrete mixing truck and the concrete mixing tank 14 and also parallel to the longitudinal axis of the truck bed frame rails 12, 13. As used herein the term "substantially parallel" shall mean plus or minus up to approximately 30 degrees of parallel. Put another way, it is desirable that when a concrete chute extension is mounted on the arms 86, 88, as described above and the fluid container 46 is mounted on the concrete mixing truck 10 as described herein, the end of the concrete chute extension distal to the fluid container should not extend beyond the sides of the truck or the truck side wheel base.

The concrete mixing tank 14 has a longitudinal axis centerline, which is the axis about which the mixing tank rotates. It is preferred that the fluid container 46 be mounted to the truck bed frame rails 12, 13 to the right or to the left of the longitudinal axis centerline of the concrete mixing tank 14. The distance from the longitudinal axis centerline to the fluid container 46 will depend on the particular size and configuration of the concrete truck 10. Most importantly, however, the fluid container 46 is mounted to the truck bed frame rail 12 at a position such that the discharge end 23 of the main concrete chute 22 and the end of the flop-down chute 24 opposite the discharge end 28 thereof (when in the folded configuration, as shown, for example, in FIGS. 1, 9 and 10) can both be positioned above the concrete chute extension 26 attached to the arms 86, 88 as described above. When the fluid container 46 is mounted on the truck bed frame rail 12 as described above, the main concrete chute 22 and the flop-down chute 24 can be positioned such that fluid, such as water, applied to them will drain from main concrete chute and flop-down concrete chute onto a concrete chute extension 26 attached to the arms 86, 88, as described above, and the same fluid will drain from the concrete chute extension into the fluid container 46.

Concrete contaminated wash water from the load charging hopper 16, the discharge hopper 20, the main concrete chute 22, the flop-down chute 24 and any concrete chute extensions, will contain some aggregate that does not get removed therefrom during a normal scrape down. Therefore, it is desirable to separate that aggregate from the water used to wash down the load charging hopper 16, the discharge hopper 20, the main concrete chute 22, the flop-down chute 24 and any concrete chute extensions. Therefore, an aggregate strainer basket 110 can optionally be used in the opening 64 of the top panel 50. The aggregate strainer basket 110 comprises a bottom foraminous plate 112, a front foraminous plate 114, a rear foraminous plate 116, a solid right side plate 118 and a solid left side plate 120. The five steel plates 112-120 form a rectangular basket with an opening 122 at the top. The aggregate strainer basket 110 is conveniently made by forming the foraminous plates 112-116 from a single sheet of foraminous steel and forming two 90 degree bends in the steel into a U-shape to form the three foraminous plates. The side panels 118-120 can then be welded to the foraminous plates 112-116. A bend is made in the portion of the panels 114-120 adjacent the opening 122 to form an outwardly extending flange 124. A handle 126 is conveniently provided for the aggregate strainer basket 110 by attaching the handle to the flange portions 124 of the panels 114, 116, such as by welding.

The size of the holes in the foraminous plates 112-116 are selected to retain aggregate of a desired size in the strainer basket 110 while permitting fluid and smaller particles to flow through the holes and into the fluid container 46. Generally, it is found that holes of approximately 5 mm to approximately 7 mm are useful in forming the foraminous plates 112-116; particularly holes of approximately 6 mm. Foraminous plates 112-116 are preferred because they are very strong and durable. However, screens of equivalent mesh size can also be used.

The aggregate strainer basket 110 is inserted into the fluid container 46 by inserting the foraminous plates 112-116 through the opening 64 and into the fluid container, such that the flange 124 on the strainer basket rests on the ledge 68. After the strainer basket 110 is inserted into the fluid container 46, the lid 82 can be closed and latched shut. In order to remove the strainer basket 110 from the fluid container 46, the latch 85 is released, the lid 82 is opened, the handle 126 is grasped by hand and pulled straight upwardly out of the fluid container.

Use of the present invention will now be considered. The concrete mixing truck 10 is driven to a concrete batch plant (not shown) where a concrete mix comprising Portland cement, sand, aggregate and water, is charged into the concrete mixing tank 14 through the load charge hopper 16. The concrete mixing truck 10 is then driven to a job site where the concrete mix is to be placed. The main chute 22 is moved from the transport position and swung away from the truck 10 so that it extends outwardly from the rear of the truck. The flop-down chute 24 is folded down to the discharge position shown in FIG. 7. A concrete chute extension 26 having hooks 42, 44 at one end 40 and posts 36, 38 at the discharge end 34 is removed from the storage position (not shown) on the side of the truck. The discharge end 28 of the flop-down chute 24 has a pair of posts 30, 32 extending outwardly therefrom (FIG. 7). The hooks 42, 44 of the concrete chute extension 26 are hooked onto the posts 30, 32 at the discharge end 28 of the flop-down chute 24 so as to extend the reach of the concrete chute (FIG. 6). If necessary to extend the reach of the concrete chute, an additional concrete chute extension (not shown) can be attached to the posts 36, 38 of the concrete chute extension 26. Typically, a concrete truck will carry a maximum of three concrete chute extensions. After the desired number of concrete chute extensions is added to the flop-down chute 24, the discharge end of the last extension is placed over the location where the concrete is to be placed, such as a concrete form for a basement wall. The concrete mixing tank 14 is then rotated in a direction so that the concrete mix is dispensed therefrom. The concrete mix falls from the opening 18 of the concrete mixing tank 14, onto and/or through the discharge hopper 24 and onto the main chute 22. The concrete mix then flows down the main chute 22 onto the flop-down chute 24 and onto the concrete chute extension 26. Finally, the concrete mix flows down the concrete chute extension 26 and fall off the discharge end 34 thereof. After the concrete mix is finished being dispensed from the concrete mixing tank 14, the discharge hopper 24, the main chute 22, the flop-down chute 24 and the chute extension 200 are scraped down with, for example a shovel, to manually remove as much as possible of the concrete mix clinging thereto. The concrete mix scraped from the chutes is allowed to fall to the ground since the plastic concrete is not considered a contaminant or an environmental hazard, as it will merely harden into cured concrete. The foregoing procedure is conventional and well known to those skilled in the art.

Figure 8:
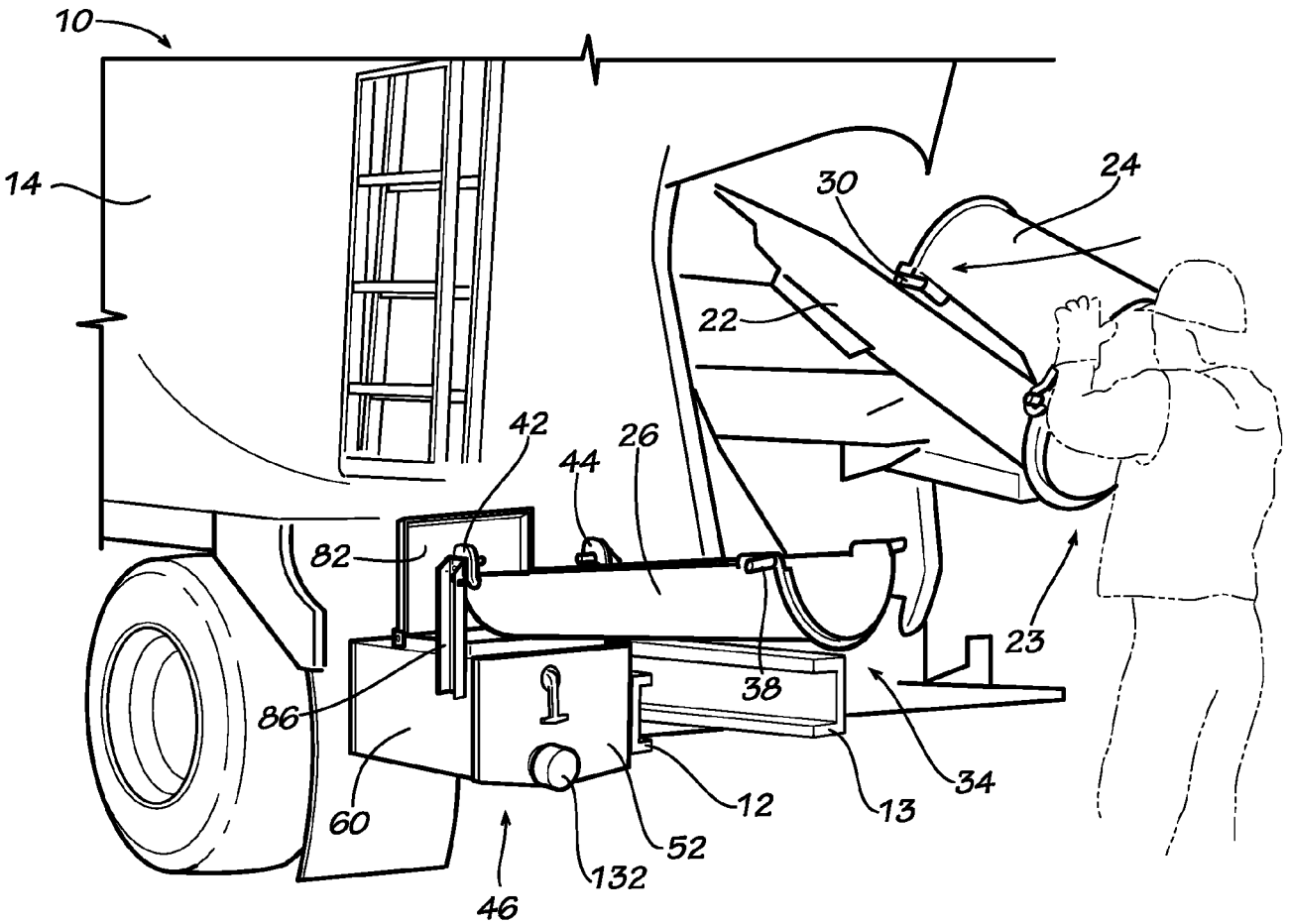
FIG. 8 is a partial rear perspective view of the concrete mixing truck and wash fluid container shown in FIG. 7 showing the concrete chute extension still mounted on the wash fluid container and an operator folding the flop-down chute onto the main chute.
Figure 9:
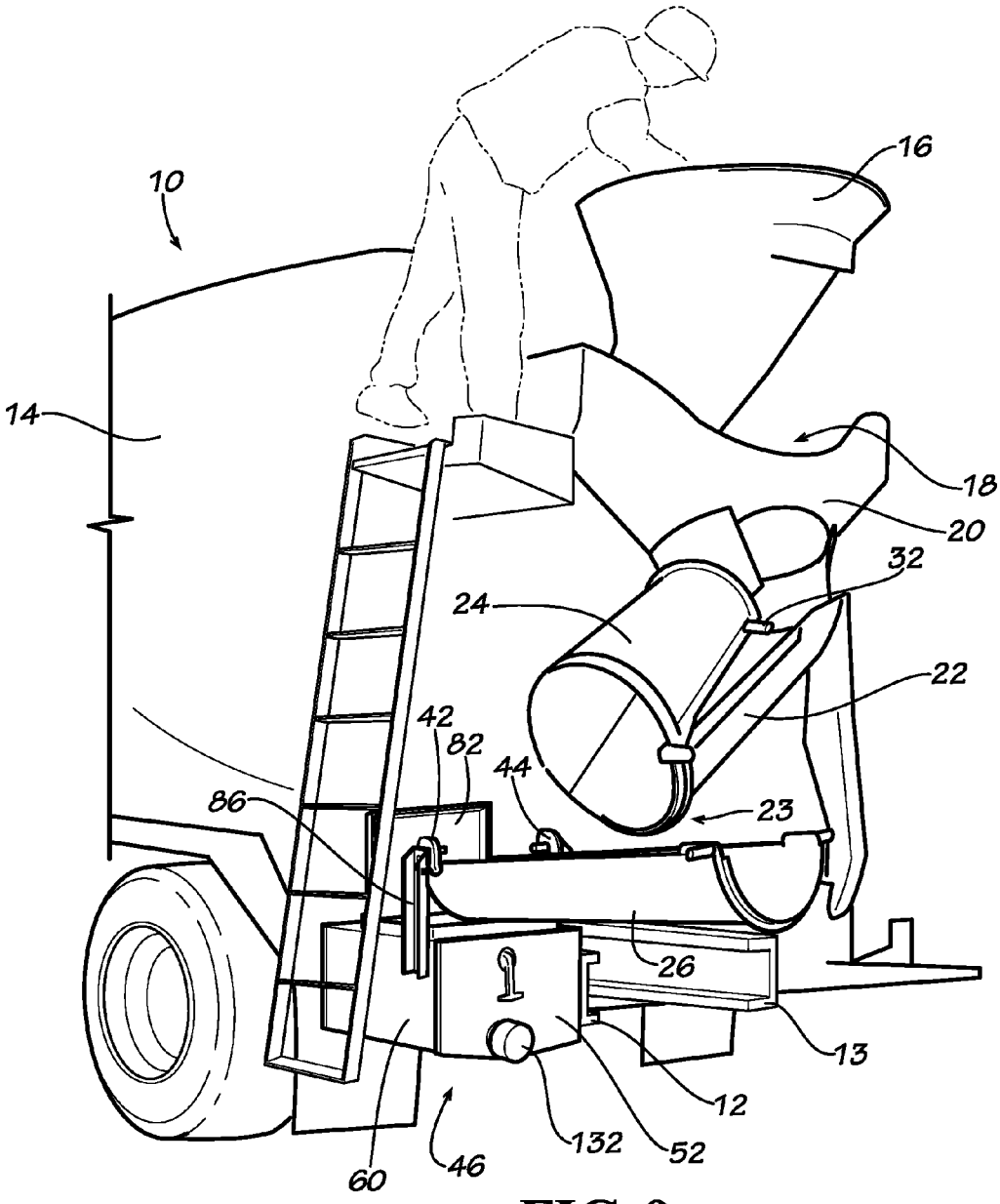
FIG. 9 is a partial rear perspective view of the concrete mixing truck and wash fluid container shown in FIG. 8 showing the concrete chute extension still mounted on the wash fluid container with the main chute and flop-down chute now positioned above the concrete chute extension and the operator beginning the washing operation starting with the load charging hopper.

The novel and nonobvious operation of the present invention will now be described. The concrete chute extension 26 is disengaged from the flop-down chute 24 by raising the discharge end 34 thereof and disengaging the hooks 42, 44 from the posts 30, 32 at the discharge end 28 of the flop-down chute 24. The hooks 42, 44 of the concrete chute extension 26 are then hooked onto the posts 94, 96 of the arms 86, 88 on the fluid container 46 (FIG. 7). Alternately, the posts 36, 38 of the concrete chute extension 26 can be inserted into the slots 98, 100 of the arms 86, 88, respectively. As explained above, when the concrete chute extension 26 is attached to the posts 94, 96 in this manner, the discharge end 34 of the concrete chute extension will be higher than the opposite end thereof which is positioned over the opening 64 of the fluid container 46. The flop-down chute 24 is then folded up onto the main chute 22 (FIG. 8) and the main chute is pivoted so that the discharge end 23 of the main chute is positioned directly above the concrete chute extension 26 (FIG. 9). A water hose (not shown), typically found on a concrete mixing truck, is then used to wash down the load charging hopper 16, the discharge hopper 20, the main chute 22, the flop-down chute 24 and the chute extension 26. Washing begins by washing concrete mix residue from the load charging hopper 16. The wash water flows from the load charging hopper 16 into the concrete mixing tank 14. The concrete mixing tank 14 is rotating in the concrete dispensing direction, if empty, so that water that flows into the tank is pushed back out due to the rotation of the tank and the flights inside the tank. Thus, the wash water from the load charging hopper 14 also washes the inside of the concrete mixing tank 14. However, it may be necessary to spray water into the concrete mixing tank 14 with the hose through the opening 18 to provide additional washing of the concrete mixing tank 14. The wash water flows from the concrete mixing tank 14 onto and through the discharge hopper 20, down the main chute 22, down the concrete chute extension 26 and into the fluid container 46. As the wash water enters the fluid container 46, it passes through the aggregate strainer basket 110, where aggregate over a desired size is retainer in the basket, while the wash water and smaller particulate material flows through the strainer basket and into the fluid container.

Next, the discharge hopper 20 is washed down with the water from the hose (not shown). The wash water flows from the discharge hopper 20, down the main chute 22, down the concrete chute extension 26 and into the fluid container 46. Again, the wash water is strained through the aggregate strainer basket 110 as it enters the fluid container 46, where coarse aggregate is removed from the wash water.

Figure 10:
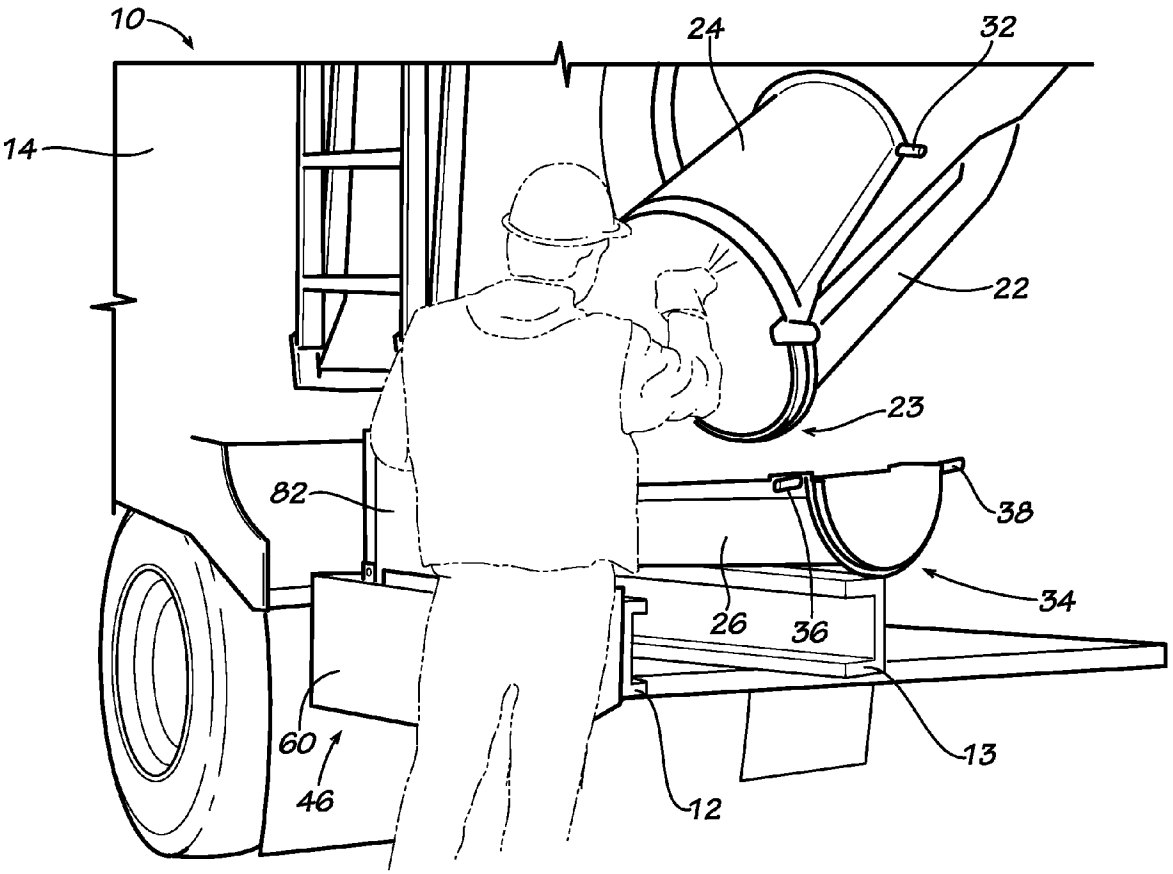
FIG. 10 is a partial rear perspective view of the concrete mixing truck and wash fluid container shown in FIG. 9 showing the concrete chute extension still mounted on the wash fluid container with the main chute and flop-down chute still positioned above the concrete chute extension and the operator washing the flop-down chute and the main chute.

Then, the flop-down chute 24 is washed down with the water from the hose (FIG. 10). Some of the wash water flows from the flop-down chute 24 onto the main chute 22; some of the wash water flows from the flop-down chute onto the concrete chute extension 26. The portion of the wash water that flows onto the main chute 22 from the flop-down chute 24 flows from the main chute onto the concrete chute extension 26. All of the water on the concrete chute extension 26 flows into the fluid container 46, first passing through the aggregate strainer basket 110, where coarse aggregate is removed from the wash water.

Then, the main chute 22 is washed down with the water from the hose. The wash water from the main chute 22 flows onto the concrete chute extension 26 and then into the fluid container 46, passing through the aggregate strainer basket 110, where coarse aggregate is removed from the wash water as it enters the fluid container.

Figure 11:
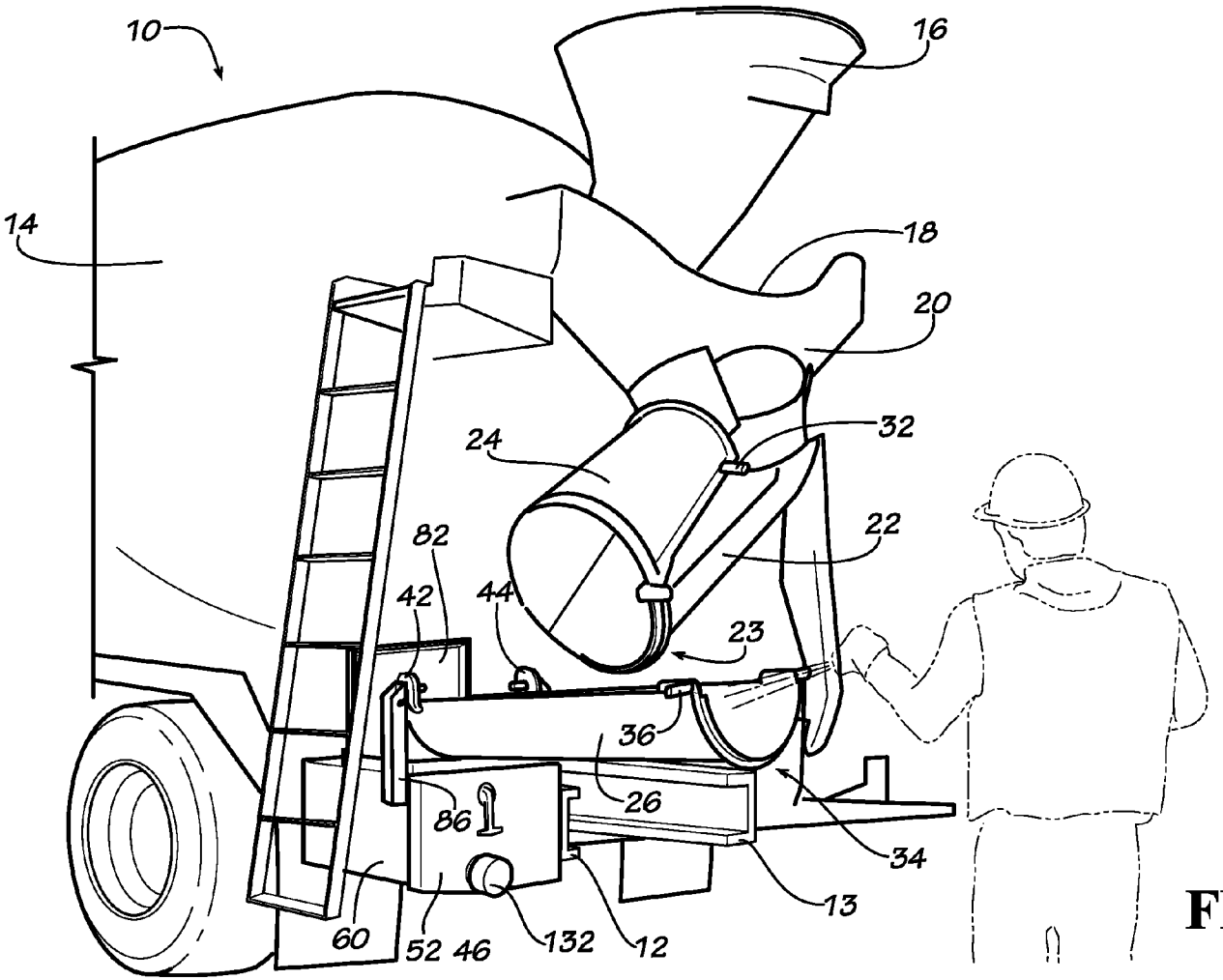
FIG. 11 is a partial rear perspective view of the concrete mixing truck and wash fluid container shown in FIG. 10 showing the concrete chute extension still mounted on the wash fluid container with the main chute and flop-down chute still positioned above the concrete chute extension and the operator washing the concrete chute extension.
Figure 12:
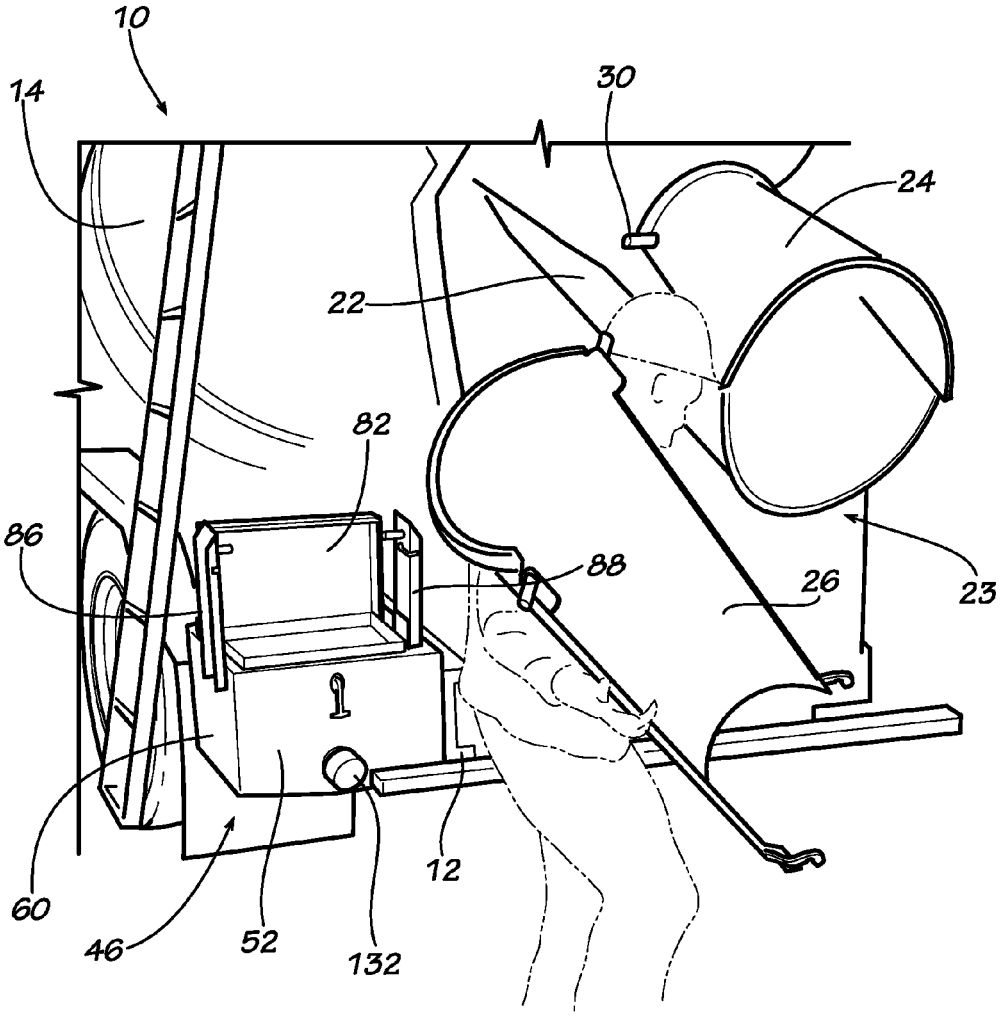
FIG. 12 is a partial rear perspective view of the concrete mixing truck and wash fluid container shown in FIG. 11 showing the concrete chute extension removed from the wash fluid container and the operator carrying the concrete chute extension to attach the concrete chute extension to the side of the truck for storage.

Finally, the concrete chute extension 26 is washed down with the wash water from the hose (FIG. 11). The wash water from the concrete chute extension 26 flows into the fluid container 46, passing through the aggregate strainer basket 110, where coarse aggregate is removed from the wash water as it enters the fluid container. The concrete chute extension 26 is then removed from the fluid container 46 by lifting the discharge end 34 and disengaging the hooks 42, 44 from the posts 30, 32. The concrete chute extension 26 can then be stowed on the truck in a manner well known in the art (FIG. 12).

If additional chute extensions (not shown) are used in addition to the concrete chute extension 26, they are washed in the same manner as the chute extension 26. They can be washed before the washing procedure described above or they can be washed after the above-described procedure. An additional chute extension is washed by disengaging the chute extension from the adjacent chute extension and attaching the additional chute extension to the fluid container 46 in the same manner as described above for the chute extension 26. The additional chute extension is then washed with water from the hose. The wash water from the additional chute extension flows into the fluid container 46, passing through the aggregate strainer basket 110 as it enters the fluid container. The additional chute extension is then removed from the fluid container 46 by lifting the discharge end and disengaging the hooks on the additional chute extension from the posts 94, 96. The additional chute extension is then stowed on the truck 10 in a manner well known in the art.

Figure 14:
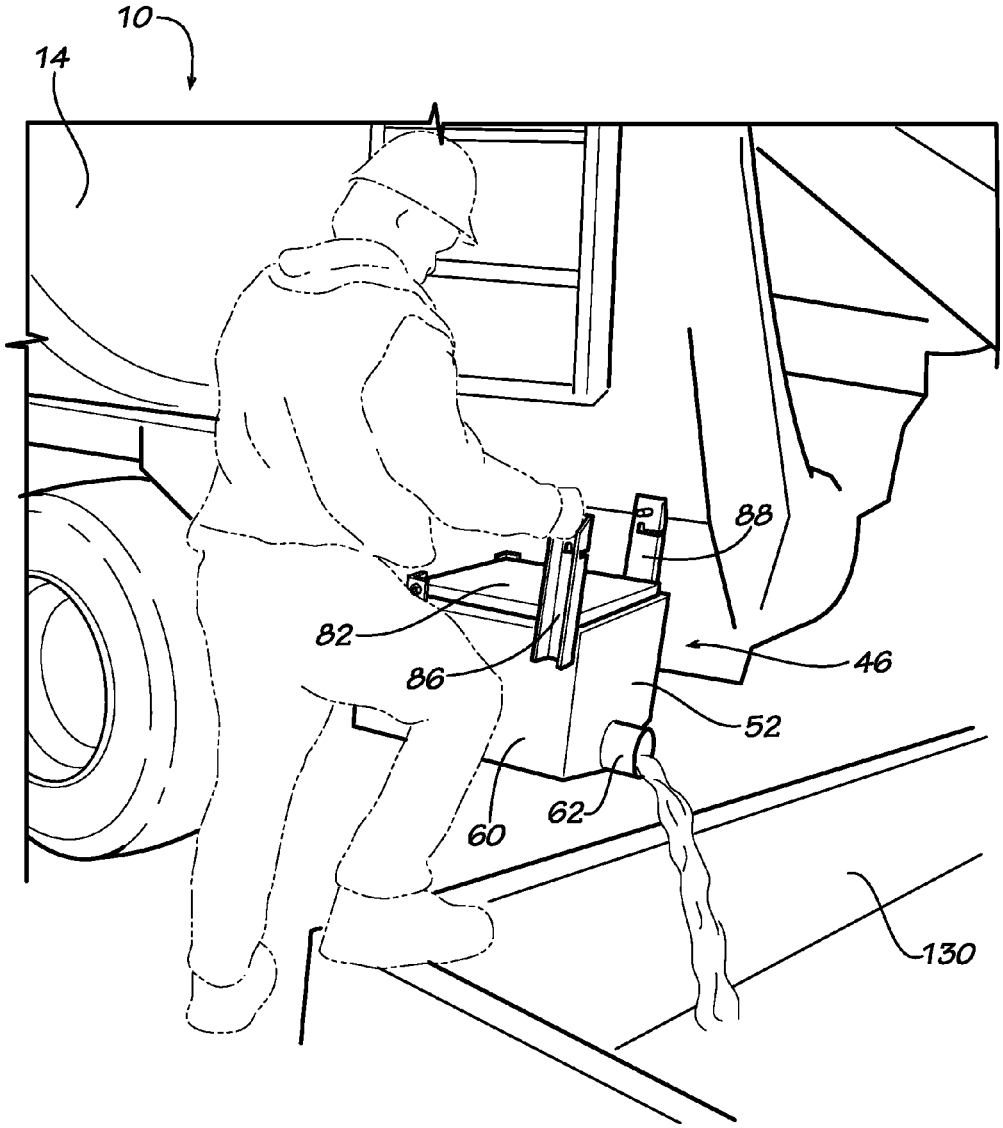
FIG. 14 is a partial rear perspective view of the concrete mixing truck and wash fluid container shown in FIG. 12 showing the operator draining the contents of the wash fluid container into a wash water disposal pond.
Figure 15:
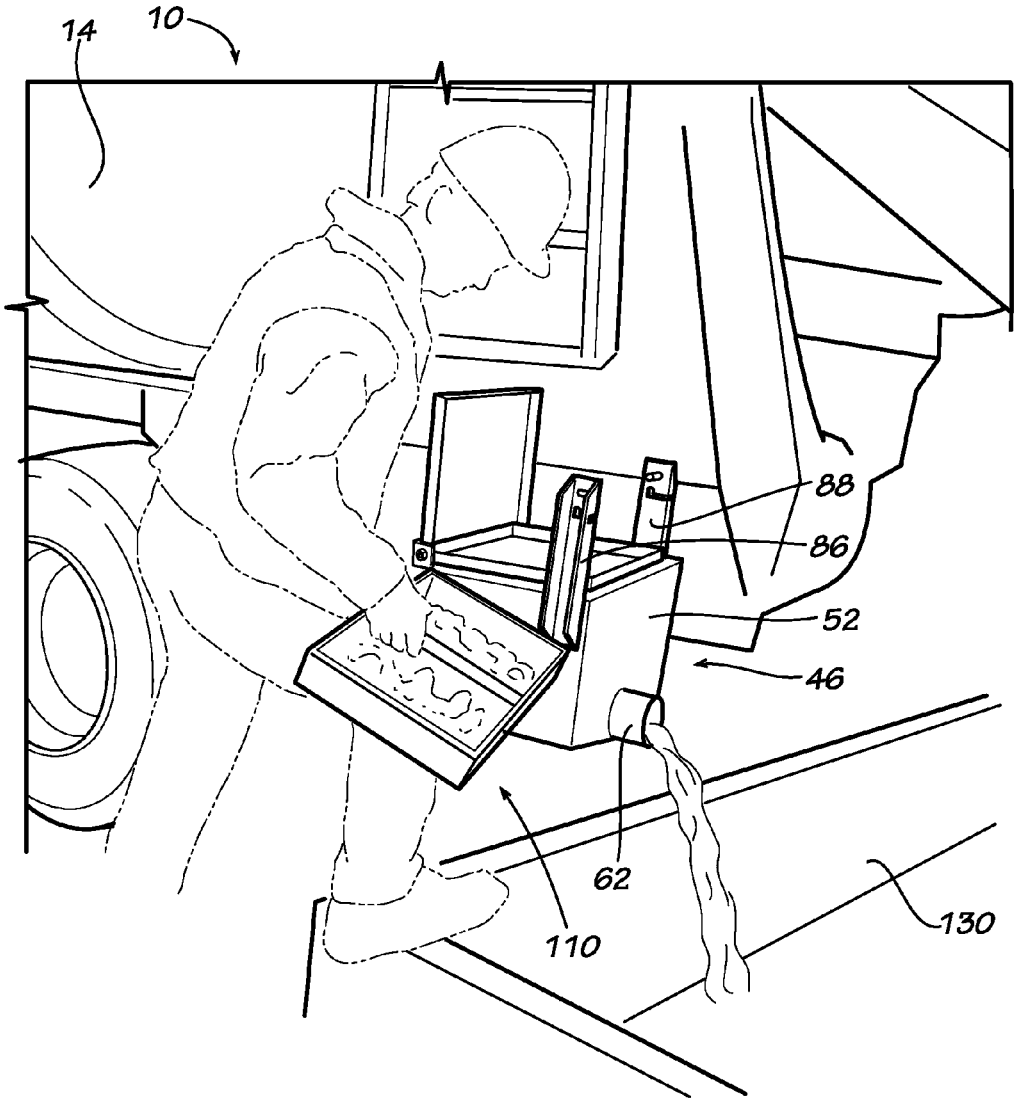
FIG. 15 is a partial rear perspective view of the concrete mixing truck and wash fluid container shown in FIG. 14 showing the aggregate strainer basket removed from the wash fluid container and the operator disposing of aggregate captured in the aggregate strainer basket.
Figure 16:
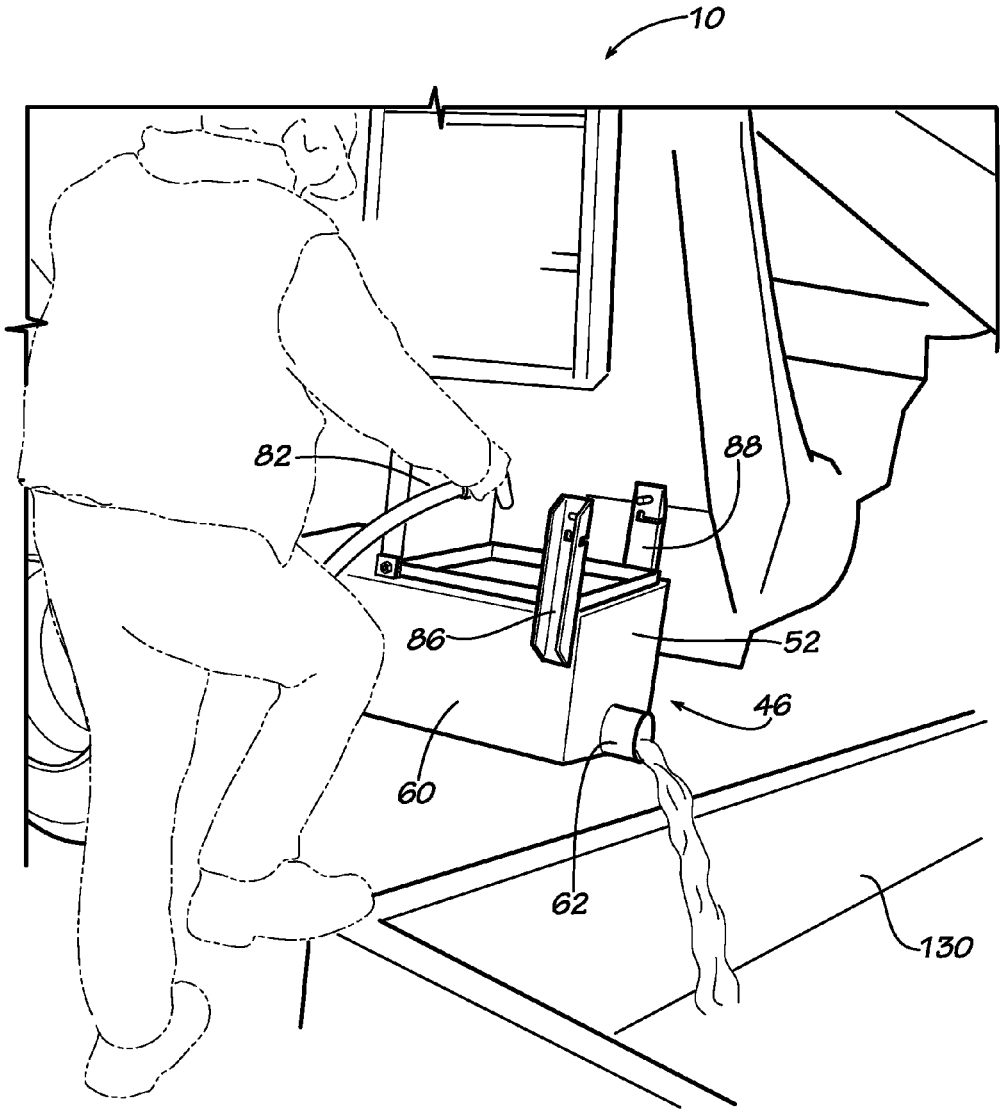
FIG. 16 is a partial rear perspective view of the concrete mixing truck and wash fluid container shown in FIG. 15 showing the operator washing the inside of the wash fluid container.

After the washing operation is completed, the lid 82 is closed and latched shut. The concrete mixing truck 10 is then driven to a location having an appropriately constructed concrete wash water disposal pond 130, such as at the batch plant. The concrete mixing truck 10 is backed up to the pond system 130 and the cap 132 is removed from the fluid container drainpipe 62 and the concrete contaminated wash water in the fluid container 46 is allowed to drain out of the drain pipe into the disposal pond (FIG. 14). The latch 85 for the lid 82 is released and the lid is raised. The aggregate strainer basket 110 is then removed from the fluid container 46 by grasping the strainer basket by the handle 126 and lifting the strainer basket out of the fluid container (FIG. 15). Any aggregate in the aggregate strainer basket 110 can then be disposed of, such as by emptying the basket onto the ground or onto an aggregate pile for recycling. Water from the hose is then used to wash any remaining residue from the fluid container, the wash water draining out of the fluid container though the drainpipe 62 (FIG. 16). When the washing and draining operation is completed, the aggregate strainer basket 110 is placed back in the fluid container 46 and the lid 82 is closed and latched shut. The cap 132 is placed back on the drainpipe 62 and the concrete truck 10 is ready to be used for another load of concrete mix.

The particular sequence of washing steps for the load charging hopper 16, the discharge hopper 20, the main chute 22, the flop-down chute 24 and the concrete chute extension 26 is not critical to the invention. Those elements can be washed in any order. However, it is more efficient to wash those elements from the top down, as described above.

In FIGS. 17, 18, 19, 20 and 21 there is shown an alternate disclosed embodiment of the present invention. FIGS. 17-21 show an alternate fluid container 200. The fluid container 200 is an L-shaped fluid container with the horizontal leg of the "L" fitting under the two rails 12, 13 that form the frame of the truck 10. This allows for an increased fluid storage capacity compared to the embodiment disclosed above. Specifically, the fluid container 200 comprises an L-shaped front panel 202 and an L-shaped rear panel 204, both of identical size and shape. The top edge 206 of the vertical portion of the "L" is parallel to the top edge 208 of the horizontal portion of the "L". However, the bottom edge 210 of the horizontal portion of the "L" is not parallel to the edges 206, 208. The bottom edge 210 slants downwardly from the left vertical edge 212 to the right vertical edge 214. This provides a non-symmetrical taper to the horizontal portion of the L-shaped fluid container 200. The fluid container is completed with a right side panel 216, an upper left side panel 218, a lower left side panel 220, a bottom panel 222, a right top panel 224 and a left top panel 226. All of the panels 202, 204, 216-226 are welded to form the fluid container shown in FIGS. 17-21. Preferably, however, the right top panel 224, the upper left side panel 218 and the left top panel 226 are fabricated from a single sheet of steel by bending the flat sheet appropriately. Similarly, the bottom panel 222, the lower left side panel 220 and the right side panel 216 can be fabricated from a single sheet of steel by bending the flat sheet appropriately.

Figure 18:
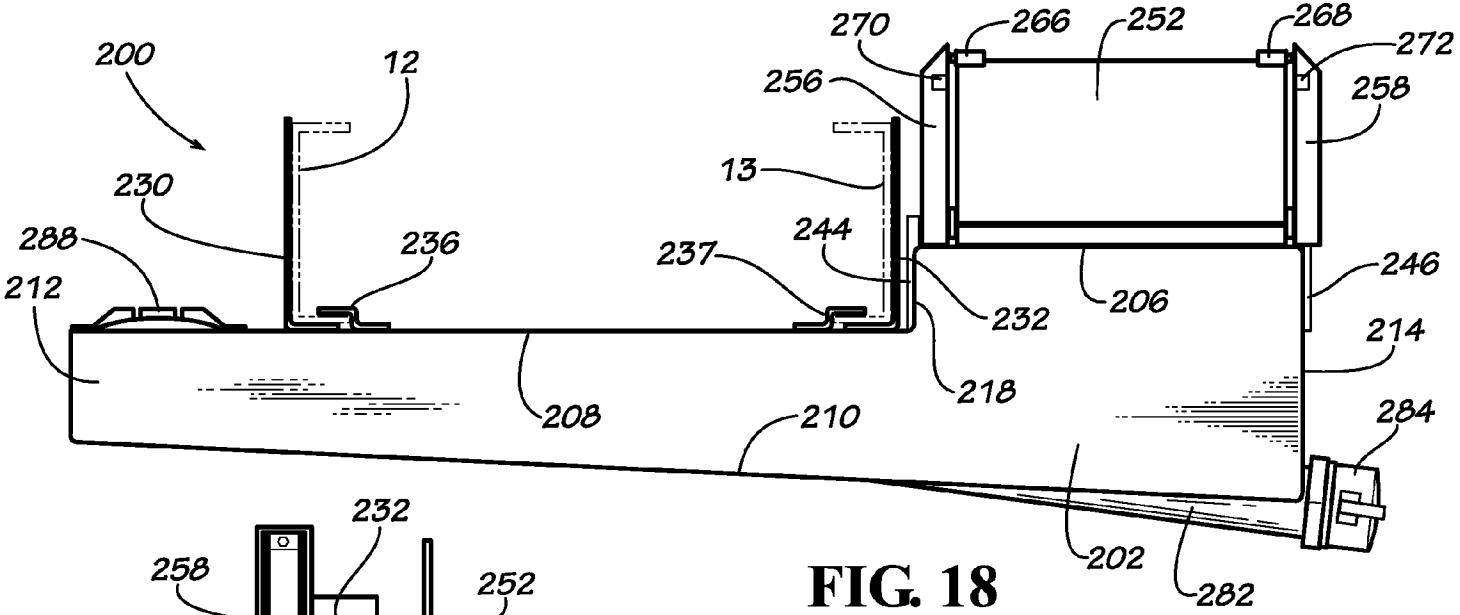
FIG. 18 is a front view of the wash fluid container shown in FIG. 17.
Figure 19:
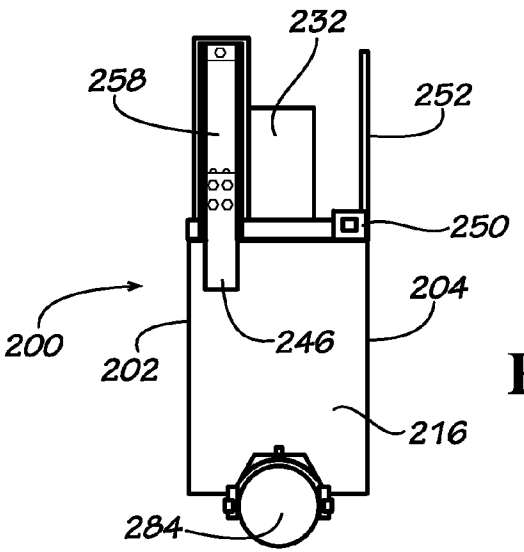
FIG. 19 is a right side view of the wash fluid container shown in FIG. 17.
Figure 20:
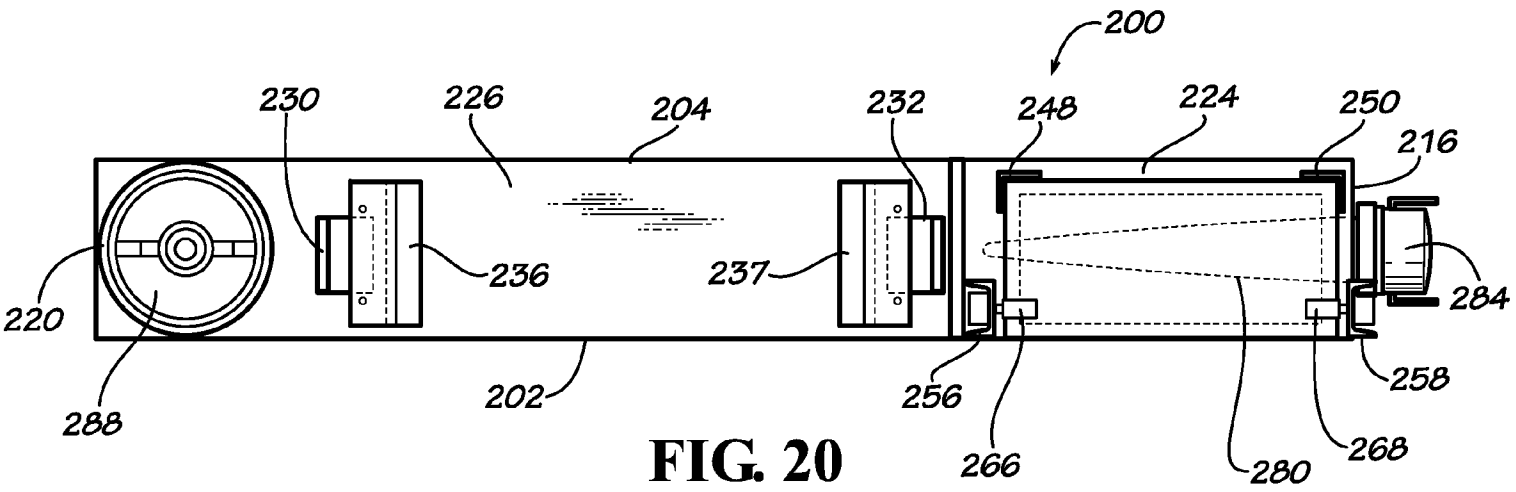
FIG. 20 is a top plan view of the wash fluid container shown in FIG. 17.
Figure 21:
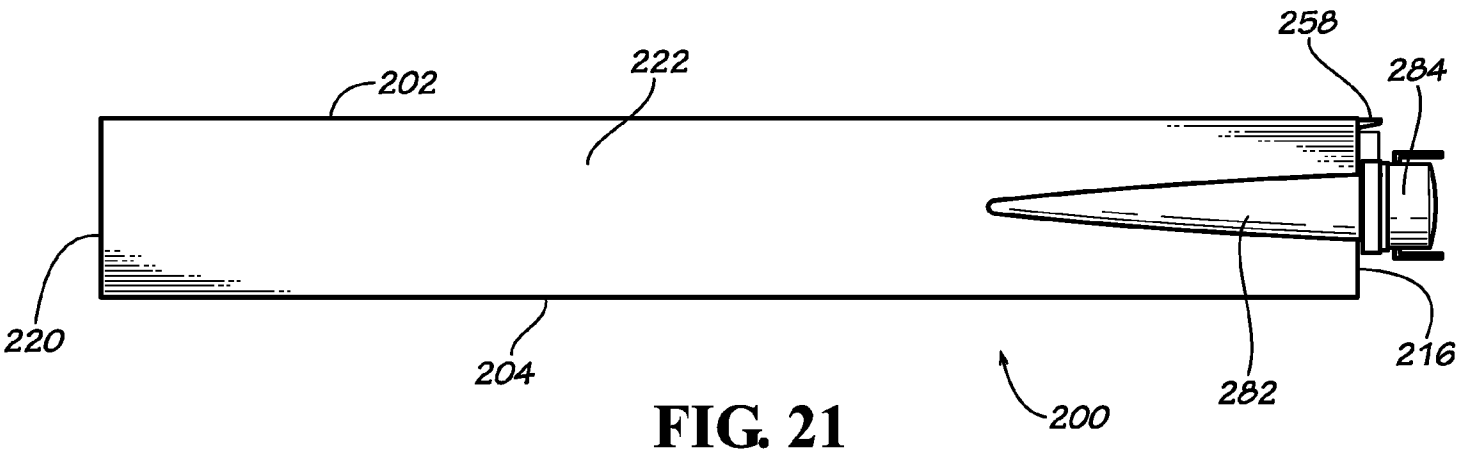
FIG. 21 is a bottom view of the wash fluid container shown in FIG. 17.

Two L-shaped fluid container mounting brackets 230, 232 are provided for mounting the fluid container 200 to the rails 12,13, respectively that forms a portion of the truck frame and extends outwardly from the bumper 235 at the center rear of the truck 10. The mounting brackets 230, 232 are welded to the left top panel 226 so that the mounting brackets are outside of the rails 12, 13. Two Z-shaped mounting brackets 236, 237 are welded to the left top panel 226 and spaced from the mounting brackets 230, 232 such that a portion of the rail 12 will be captured between the brackets 230, 236 and between the bracket 232, 237 (FIGS. 18, 20). The fluid container 200 mounts to the truck by sliding the rails 12, 13 between the brackets 230, 236 and between the brackets 232, 237 and bolting the mounting bracket 230 to the rail 12 and by bolting the mounting bracket 232 to the rail 13.

A rectangular opening 238 is formed in the right top panel 224. An upstanding rectangular frame 240 is formed around the opening 238 and is welded to the right top panel 224. Two mounting brackets 244, 246 extend upwardly from the surface of the right top panel 224. The mounting bracket 244 is welded to the upper left side panel 218 and the other mounting bracket 246 is welded to the right side panel 216. Two hinge brackets 248, 250 extend outwardly from the right top panel 224 and are welded thereto.

A rectangular lid 252 is pivotably attached to the hinge brackets 248, 250 so that the lid can be raised and lowered to uncover and cover, respectively, the opening 238 in the right top plate 224. A latch (not shown) is provided for selectively fastening or releasing the rectangular lid 252 from the closed position.

A pair of elongate adjustable arms 256, 258 is mounted on the mounting brackets 244, 246. Each of the arms 256, 258 includes a pair of slots 260, 262 formed therein. The arms 256, 258 are mounted to the mounting brackets 244, 246 by inserting bolts (not shown) through the slots 260, 262 and through corresponding holes in the corresponding mounting bracket 244, 246. A nut (not shown) fits on each bolt thereby securing the arms 256, 258 to the mounting brackets 244, 246, respectively. The slots 260, 262 in the arms 256, 258 allow the arms to be raised or lowered to thereby accommodate concrete chute extensions of different dimensions.

On each of the arms 256, 258 adjacent the ends distal from the mounting brackets 244, 246 are a pair of pins 266, 268, respectively, that extend inwardly toward each other. The pins 266, 268 are sized and shaped to mate with the hooks, such as the hooks 42, 44, that are typically found on one end of a concrete chute extension, such as the concrete extension chute 26. On each of the arms 256, 258 adjacent the ends distal from the mounting brackets 244, 246 are a pair of slots 270, 272, respectively, that are sized and shaped to mate with the pins, such as the pins 36, 38, that are typically found on one end of a concrete chute extension, such as the concrete extension chute 26 (FIG. 17). The arms 256, 258 are adjusted to a height so that when a concrete chute extension is attached to the arms one end of the chute is positioned over the rectangular opening 238 in the right top panel 224 and the other end of the chute is at a higher elevation than the end over the opening. Therefore, when a concrete chute extension is mounted on the arms 256, 258, as described above, any fluid, such as water, on the concrete chute extension will drain into the fluid container 200 through the rectangular opening 238 under the influence of gravity. Furthermore, when a concrete chute extension is mounted on the arms 256, 258, as described above and the fluid container 200 is mounted on the rails 12, 13 of the concrete mixing truck 10, as described above, the longitudinal axis of the concrete chute extension will be parallel to the longitudinal axis of the concrete mixing truck and the concrete mixing tank 14.

The concrete mixing tank 14 has a longitudinal axis centerline, which is the axis about which the mixing tank rotates. It is preferred that the fluid container 200 be mounted to the truck bed frame rails 12, 13 to the right of the longitudinal axis centerline of the concrete mixing tank 14 and such that the portion of the fluid container extending horizontally outwardly from the upper left panel 226 fits under the rails 12, 13 of the truck 10. Most importantly, however, the fluid container 200 is mounted to the truck bed frame rail 12, 13 such that the discharge end 23 of the main concrete chute 22 and the end of the flop-down chute 24 opposite the discharge end 28 thereof (when in the folded configuration) can both be positioned above a concrete chute extension attached to the arms 256, 258 as described above. When the fluid container 200 is mounted on the truck bed frame rail 12, 13 as described above, the main concrete chute 22 and the flop-down chute 24 can be positioned such that fluid, such as water, applied to them will drain from them onto a concrete chute extension attached to the arms 256, 258, as described above, and the same fluid will drain from the concrete chute extension into the fluid container 200 through the rectangular opening 238.

The aggregate strainer basket 110 can be used with the fluid container 200 in the same manner as described above with respect to the fluid container 46. The aggregate strainer basket 110 is inserted into the fluid container 200 by inserting the foraminous plates 112-116 through the opening 238 and into the fluid container, such that the flange 124 on the strainer basket rests on the ledge of the opening 238. After the strainer basket 110 is inserted into the fluid container 200, the lid 252 can be closed and latched shut. In order to remove the strainer basket 110 from the fluid container 200, the latch (not shown) is released, the lid 252 is opened, the handle 126 is grasped by hand and pulled straight upwardly out of the fluid container.

A through V-shaped opening 280 is formed in the bottom panel 222 and extending toward the right side panel 216. A round drainpipe 282 is cut on an angle so that a corresponding V-shaped opening is formed in the drainpipe. The drainpipe 282 is welded to the bottom panel 222 such that the V-shaped opening in the pipe fits the V-shaped opening 280 in the bottom panel and the drainpipe extends outwardly from the right panel 216. The drainpipe 282 cooperates with the fluid container 200 so that fluid in the fluid container will flow out of the drainpipe under the influence of gravity. A cap 284 is selective attachable to the drainpipe 280 to prevent fluid in the fluid container 200 from flowing out of the drainpipe when the cap is attached to the drainpipe. The drainpipe 282 can also be positioned to discharge out the back of the fluid container 200; i.e., through the L-shaped front panel 202.

A round opening 286 is formed in the left top panel 226 at the end distal from the opening 238. A removable round lid 288 is selectively connectable to the left top lid 226, such as by screw threads or a bayonet-type attachment, so that the lid can be attached to the left top panel thereby closing the opening 286 or removed therefrom, thereby allowing access to the fluid container 200 through the opening 286. Thus, during the cleanout step of the fluid container, after the cap 284 has been removed and the fluid contents of the fluid container drained therefrom through the drainpipe 282, the lid 288 is removed and the hose (not shown) can be inserted into the opening 286 to aid in washing out the contents of the fluid container 200. Similarly, the lid 252 is opened and the hose (not shown) can be inserted into the fluid container 200 through the opening 238 to wash the interior of the fluid container.

A portion of the front panel 202, a portion of the rear panel 204, the right side panel 216, the upper left side panel 218, a portion of the bottom panel 222 and right top panel 224 define a first fluid chamber in the fluid container 200. A portion of the front panel 202, a portion of the rear panel 204, the lower left side panel 220, a portion of the bottom panel 222 and the left top panel 226 define a second fluid chamber in the fluid container 200. The first fluid chamber fits to the side of the rails 12, 13, while the second fluid chamber fits under the rails. The first fluid chamber and the second fluid chamber are in fluid communication with each other. When the fluid contained in the fluid container 200 is drained out the drainpipe 282, the fluid in both the first fluid chamber and the second fluid chamber will drain from the fluid container out the drainpipe.

This alternate embodiment of the fluid container 200 is used in the same manner, as described above, with respect to the fluid container 46.

It should be understood, of course, that the foregoing relates only to certain disclosed embodiments of the present invention and that numerous modifications or alterations may be made therein without departing from the spirit and scope of the invention as set forth in the appended claims.

What is claimed is:

1. A method for washing contaminants from concrete chutes comprising:

positioning a first concrete chute member such that a first end of the first concrete chute member is disposed above an opening in a container attached to a concrete mixing truck and the first concrete chute member is maintained at an angle such that a second end of the first concrete chute member is higher than the first end thereof and wherein the first concrete chute member has a "U" transverse cross-sectional shape;

positioning a second concrete chute member having an open end adjacent the first concrete chute member, such that the open end of the second concrete chute member is higher than a second end of the second concrete chute member and such that fluid applied to the second concrete chute member flows through the open end onto the first concrete chute member which then flows from the first concrete chute member into the container, wherein the first and second concrete chute members are not coaxially aligned; and applying fluid to the second concrete chute member such that the fluid flows through the open end onto the first concrete chute member which then flows from the first concrete chute member into the container.

2. The method of claim 1 further comprising straining the fluid that flows from the first concrete chute member to remove particulate matter therefrom as the fluid flows into the container.

3. The method of claim 1, wherein the first concrete chute member is removably connected to the container.

4. The method of claim 1 further comprising positioning a third concrete chute member above the first concrete chute member, such that a first end of the third concrete chute member is higher than a second end of the first concrete chute member and such that fluid applied to the third concrete chute member washes contaminants therefrom onto the first concrete chute member which then flows from the first concrete chute member into the container.

5. The method of claim 4, wherein the second and third concrete chute members are pivotably attached to each other.

6. The method of claim 1, wherein a longitudinal axis of the first concrete chute is substantially parallel to a longitudinal axis of concrete mixing truck.

7. The method of claim 1 further comprising draining the contents of the container into a concrete disposal area.

* * * * *